US011072992B1

(12) United States Patent
Milne et al.

(10) Patent No.: US 11,072,992 B1
(45) Date of Patent: Jul. 27, 2021

(54) FRAC PLUG HIGH EXPANSION ELEMENT RETAINER

(71) Applicant: Halliburton Energy Services, Inc., Houston, TX (US)

(72) Inventors: Adam Jacob Milne, Flower Mound, TX (US); Aaron Jacob Miller, Addison, TX (US); Zachery Ryan Olson, San Antonio, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/848,611

(22) Filed: Apr. 14, 2020

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC .. E21B 33/12; E21B 33/1208; E21B 33/1216; E21B 33/128; E21B 33/1285
See application file for complete search history.

(56) References Cited

U.S. PATENT DOCUMENTS

| | | | | |
|---|---|---|---|---|
| 5,603,511 | A | 2/1997 | Keyser, Jr. et al. | |
| 7,373,973 | B2 | 5/2008 | Smith et al. | |
| 8,403,036 | B2 | 3/2013 | Neer et al. | |
| 10,316,614 | B2 | 6/2019 | Fripp et al. | |
| 2007/0044977 | A1 | 3/2007 | Hendrickson et al. | |
| 2008/0061510 | A1* | 3/2008 | Li | E21B 33/10 166/382 |
| 2010/0276159 | A1 | 11/2010 | Mailand et al. | |
| 2013/0240203 | A1* | 9/2013 | Frazier | E21B 33/134 166/193 |
| 2016/0097253 | A1* | 4/2016 | Ruffo | E21B 33/1216 166/180 |
| 2017/0002621 | A1* | 1/2017 | White | E21B 33/128 |

(Continued)

FOREIGN PATENT DOCUMENTS

WO 2016032758 A1 3/2016

OTHER PUBLICATIONS

Foreign Communication from Related Application—International Search Report and Written Opinion of the International Searching Authority, International Application No. PCT/US2021/013199, dated Apr. 29, 2021, 11 pages.

*Primary Examiner* — David Carroll
(74) *Attorney, Agent, or Firm* — Conley Rose, P.C.; Rodney B. Carroll

(57) ABSTRACT

A wellbore isolation device, comprising: a mandrel 24 having a cylindrical body, a sealing element 38 disposed about the mandrel 24 and radially expandable from a first run-in diameter to sealing engagement with the an inner surface 50 of the wellbore 6; a metal backup ring 60 disposed on the mandrel 24 contacting one side of the sealing element system 38 with an initial height H and radially expandable and axially deformable to abut the inner surface 50 of the wellbore 6; wherein the metal backup ring 60 is a concave cross-section about the mandrel 24 with an uphole leg and a downhole leg; and wherein an applied compressive force expands the sealing element system 38 into sealing engagement with the wellbore 6 and the metal backup ring 60 radially expands while axially deforming to abut the inner surface 50 of the wellbore 6 with no contact pressure.

20 Claims, 12 Drawing Sheets

(56) References Cited

U.S. PATENT DOCUMENTS

| | | | | |
|---|---|---|---|---|
| 2017/0130552 | A1* | 5/2017 | Moyes | E21B 33/128 |
| 2017/0145776 | A1* | 5/2017 | Silva | E21B 33/134 |
| 2018/0313184 | A1* | 11/2018 | Merron | E21B 33/1216 |
| 2018/0363409 | A1* | 12/2018 | Frazier | E21B 33/128 |
| 2019/0071949 | A1 | 3/2019 | Batson, Jr. et al. | |

* cited by examiner

FRAC PLUG HIGH EXPANSION ELEMENT RETAINER

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

Downhole tools used in the oil and gas industry and, more particularly, to wellbore isolation devices that use expandable sealing systems are described herein.

BACKGROUND

In the drilling, completion, and stimulation of hydrocarbon-producing wells, a variety of downhole tools are used. For example, it is often desirable to seal portions of a wellbore targeted for treatment. For example, during fracturing operations, various fluids and slurries are pumped from the surface into the casing string and forced out into a surrounding subterranean formation, but only certain desired zones of interest should receive the fracturing fluid. It thus becomes necessary to seal the wellbore and thereby provide zonal isolation to target the treatment to the desired zone. Wellbore isolation devices, such as packers, bridge plugs, and fracturing plugs (i.e., "frac" plugs) are designed for these general purposes and are well known in the art of producing hydrocarbons, such as oil and gas. Such wellbore isolation devices may be used in direct contact with the formation face of the wellbore, with a casing string extended and secured within the wellbore, or with a screen or wire mesh.

Wellbore isolation devices, such as packers, bridge plugs, and frac plugs, provide a sealing system between the outside of the isolation device body and inside of the casing so as to prevent fluid flow outside of tubing utilized in well operations. A packer assembly may allow for fluid flow through its mandrel and hence through the tubing to which it is connected. A bridge plug may have a solid mandrel and block all fluid flow in the tubing. In a frac plug, the one-way valve provides for one-directional flow upward through the tubing by governing flow through the mandrel of the frac plug, which is in fluid flow communication with the tubing.

Wellbore isolation devices may have a sealing system and an anchoring system. The sealing systems may rely on a single element or multiple elements to form the isolation seal. The anchoring system may have one or two sets of slips to anchor to the tubing.

After the desired downhole operation is complete, the seal formed by the wellbore isolation device may be relaxed, the anchoring system released, and the tool itself removed from the wellbore. Removing the wellbore isolation device may allow hydrocarbon production operations to commence without being hindered by the presence of the downhole tool. Removal of a wellbore isolation device may be accomplished by a retrieval tool that disengages the assembly, a retrieval operation that involves milling or drilling out a portion of the wellbore isolation device or the dissolution of the material of the wellbore device by dissolving, eroding, or corrosion.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

BRIEF DESCRIPTION OF THE DRAWINGS

Figure 1:
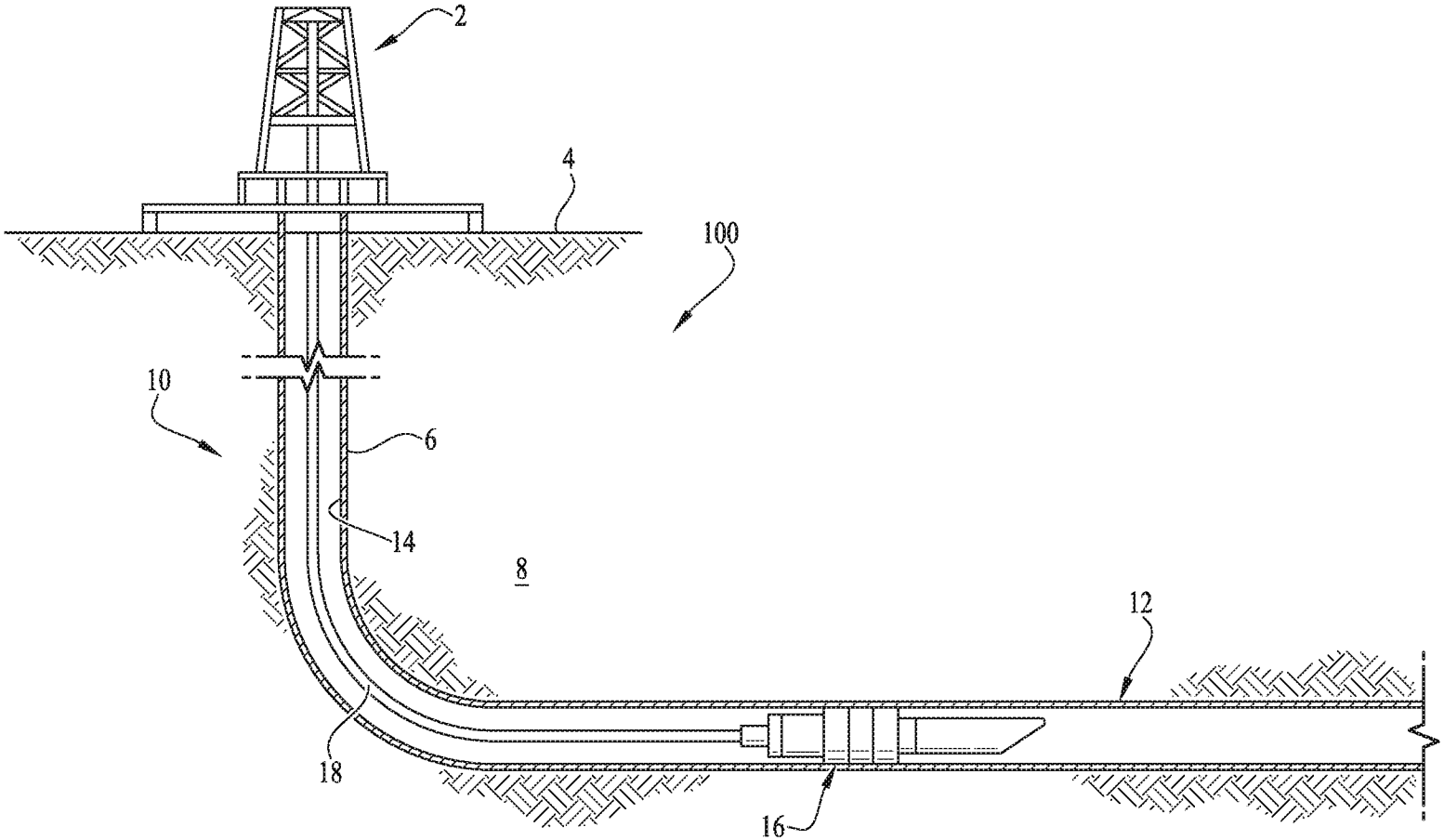
FIG. 1 is a cut-away illustration of an embodiment of a wellbore isolation device according to an embodiment.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "above" meaning toward the surface of the wellbore and with "down," "lower," "downward," or "below" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal,"

"longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings. Further, combinations of the embodiments disclosed herein are also contemplated by this disclosure.

Packers are utilized in production wells to provide an annular seal between the outside of the production tubing and the inside of the well casing. Packers are typically placed at the bottom of the well near where the production fluids, e.g., oil and gas, enter the well through perforations or an uncased section. The production fluids may also contain corrosive elements such as sand, water, and acids that are produced to the surface along with the desired hydrocarbons. The annular seal isolates the corrosive production fluids from the well casing above the packer to surface and directs the production flow to the attached production tubing.

Packers may utilize slips to anchor or grip the well casing. Slip system typically uses one part with teeth, called a slip, which may be pushed up a cone shaped part, called a wedge, into engagement with the well casing. The slip holds the packer in place against the hydraulic forces of the annular seal.

Packers are one type of well tool that provides wellbore isolation with sealing elements and slips. Production packers protect the wellbore from production fluids for the life of the well. Retrievable service packers may be placed in a well temporarily for well servicing operations such as cement squeezing, acidizing, fracturing, and well testing. Bridge plugs are used as temporary plugs to isolate a part of the well or to plug the well for temporary abandonment. Frac plugs isolate pressure from above, but allow flow from below. Frac plugs isolate a lower zone in the well so that an upper zone can be fractured with water and sand. All of these tools are examples of wellbore isolation devices.

Wellbore isolation devices utilize expandable sealing systems to seal between the packer mandrel and the inside of the casing. The sealing element systems typically include a metal backup ring, and plastic, elastomeric, or rubber sealing elements. These element systems expand from the tool to seal against the casing. The amount of expansion is generally limited by the backup ring design.

Disclosed herein is a wellbore isolation device with embodiments describing a sealing element system to seal and isolate portions of a wellbore. The expandable sealing systems include a metal backup ring and plastic, elastomeric, or rubber sealing elements and may allow the sealing systems to expand across larger gaps and therefore provide various advantages over traditional elastomeric or rubber sealing elements. For instance, the expandable sealing systems described herein are able to provide a seal across a much wider gap between the isolation device outside surface and the casing inside surface within the wellbore, which may allow the wellbore isolation device to be used in more casing sizes while utilizing fewer parts. The metal backup ring expands to contact the casing to contain the plastic, elastomeric, or rubber sealing elements to prevent creep, flow, or material loss of the sealing elements due to elevated pressure or temperatures. The metal backup ring may also anchor the wellbore isolation device to the casing by gripping the inner surface when it expands. The scaling elements may be made of degradable or non-degradable materials. The metal backup ring may be made from of degradable or non-degradable materials.

Referring to FIG. 1, illustrated is a well that may embody or otherwise employ one or more principles of the present disclosure, according to one or more embodiments. As illustrated, the well system 100 may include a service rig 2 that may be positioned on the earth's surface 4 and extends over and around a wellbore 6 that penetrates a subterranean formation 8. The service rig 2 may be a drilling rig, a completion rig, a workover rig, or the like. In some embodiments, the service rig 2 may be omitted and replaced with a standard surface wellhead completion or installation, without departing from the scope of the disclosure. While the well system 100 is depicted as a land-based operation, it will be appreciated that the principles of the present disclosure could equally be applied in any sea-based or sub-sea application where the service rig 2 may be a floating platform or sub-surface wellhead installation, as generally known in the art.

The wellbore 6 may be drilled into the subterranean formation 8 using any suitable drilling technique and may extend in a substantially vertical direction away from the earth's surface 4 over a vertical wellbore portion 10. At some point in the wellbore 6, the vertical wellbore portion 10 may deviate from vertical relative to the earth's surface 4 and transition into a substantially horizontal wellbore portion 12. In some embodiments, the wellbore 6 may be completed by cementing a casing string 14 within the wellbore 6 along all or a portion thereof. In other embodiments, however, the casing string 14 may be omitted from all or a portion of the wellbore 6 and the principles of the present disclosure may equally apply to an "open-hole" environment. The term wellbore may refer to a casing string, a liner string, a production tubing string, or an open-hole wellbore.

The well system 100 may further include a wellbore isolation device 16 that may be conveyed into the wellbore 6 on a conveyance 18 that extends from the service rig 2. The wellbore isolation device 16 may include or otherwise comprise any type of casing or borehole isolation device known to those skilled in the art including, but not limited to, a frac plug, a bridge plug, a wellbore packer, a wiper plug, a cement plug, or any combination thereof. The conveyance 18 that delivers the wellbore isolation device 16 downhole may be, but is not limited to, wireline, slickline, an electric line, coiled tubing, drill pipe, production tubing, or the like.

The wellbore isolation device 16 may be conveyed downhole to a target location (not shown) within the wellbore 6. At the target location, the wellbore isolation device may be actuated or "set" to seal the wellbore 6 and otherwise provide a point of fluid isolation within the wellbore 6. In some embodiments, the wellbore isolation device 16 may be pumped to the target location using hydraulic pressure applied from the service rig 2 at the earth's surface 4. In such embodiments, the conveyance 18 serves to maintain control of the wellbore isolation device 16 as it traverses the wellbore 6 and may provide power to actuate and set the wellbore isolation device 16 upon reaching the target location. In other embodiments, the wellbore isolation device 16 freely falls to the target location under the force of gravity to traverse all or part of the wellbore 6.

It will be appreciated by those skilled in the art that even though FIG. 1 depicts the wellbore isolation device 16 as being arranged and operating in the horizontal wellbore portion 12 of the wellbore 6, the embodiments described herein are equally applicable for use in portions of the wellbore 6 that are vertical, deviated, or otherwise slanted. Moreover, use of directional terms such as above, below, upper, lower, upward, downward, uphole, downhole, and the like are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well.

Figure 2:
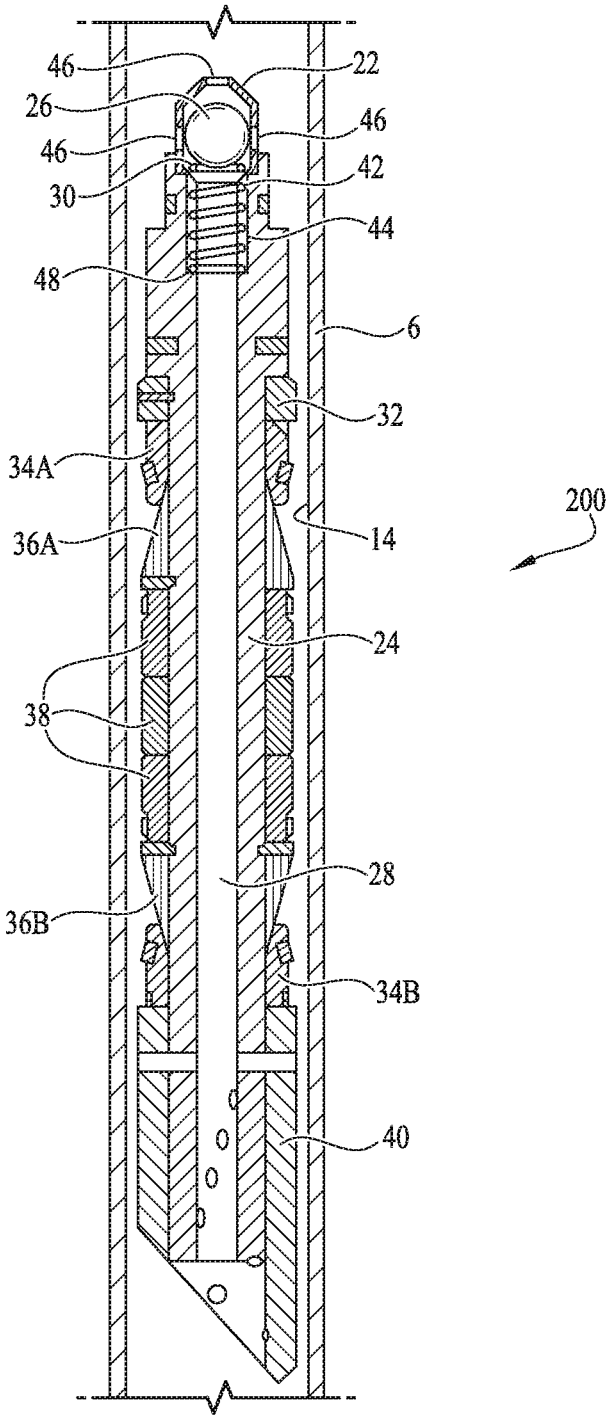
FIG. 2 is a cross-section view of an embodiment of a frac plug in the wellbore.

Referring now to FIG. 2, with continued reference to FIG. 1, illustrated is a cross-sectional view of an exemplary wellbore isolation device 200 that may employ one or more of the principles of the present disclosure, according to one or more embodiments. The wellbore isolation device 200 may be similar to or the same as the wellbore isolation device 16 of FIG. 1. Accordingly, the wellbore isolation device 200 may be configured to be extended into and seal the wellbore 6 at a target location, and thereby prevent fluid flow past the wellbore isolation device 200 for wellbore completion and/or stimulation operations. As illustrated, the wellbore 6 may be lined with the casing string 14 or another type of wellbore liner or tubing in which the wellbore isolation device 200 may suitably be set.

The wellbore isolation device 200 is generally depicted and described herein as a hydraulic frac plug. It will be appreciated by those skilled in the art, however, that the principles of this disclosure may equally be applied to any of the other aforementioned types of casing or borehole isolation devices, without departing from the scope of the disclosure. Indeed, the wellbore isolation device 200 may be any of a frac plug, a bridge plug, a wellbore packer, an open-hole packer, a wiper plug, a cement plug, or any combination thereof in keeping with the principles of the present disclosure.

As illustrated, the wellbore isolation device 200 may include a ball cage 22 extending from or otherwise coupled to the upper end of a mandrel 24. A sealing or "frac" ball 26 is disposed in the ball cage 22 and the mandrel 24 defines a central flow passage 28. The mandrel 24 also defines a ball seat 30 at its upper end. In other embodiments, the ball cage 22 may be omitted and the ball 26 may alternatively be run into the hole at a different time than the rest of the wellbore isolation device 200. One or more spacer rings 32 (one shown) may be secured to the mandrel 24 and otherwise extend thereabout. The spacer ring 32 provides an abutment, which axially retains a set of upper slips 34A that are also positioned circumferentially about the mandrel 24. As illustrated, a set of lower slips 34B may be arranged distally from the upper slips 34A.

One or more slip wedges 36 (shown as upper slip wedge 36A and lower slip wedge 36B, respectively) may also be positioned circumferentially about the mandrel 24, and one or more sealing elements 38 may be disposed between the upper slip wedge 36A and lower slip wedge 36B and otherwise arranged about the mandrel 24. In some embodiments, one of the upper slip wedge and upper slip wedge 36A, may be replaced with a radial shoulder (not shown) provided by the mandrel 24. In such embodiments, one end of the sealing elements 38 may bias and otherwise engage the radial shoulder during operation. While three sealing elements 38 are shown in FIG. 2, the principles of the present disclosure are equally applicable to wellbore isolation devices that employ more or less than three sealing elements 38, without departing from the scope of the disclosure.

A mule shoe 40 may be positioned at or otherwise secured to the mandrel 24 at its lower or distal end. As will be appreciated, the lower most portion of the wellbore isolation device 20 need not be a mule shoe 40, but could be any type of section that serves to terminate the structure of the wellbore isolation device 20, or otherwise serves as a connector for connecting the wellbore isolation device 20 to other tools, such as a valve, tubing, or other downhole equipment.

In some embodiments, a spring 42 may be arranged within a chamber 44 defined in the mandrel 24 and otherwise positioned coaxial with and fluidly coupled to the central flow passage 28. At one end, the spring 42 engages a shoulder 48 defined by the chamber 44 and at its opposing end the spring 42 biases and otherwise supports the ball 26. The ball cage 22 may define a plurality of ports 46 (three shown) that allow the flow of fluids therethrough, thereby allowing fluids to flow through the length of the wellbore isolation device 20 via the central flow passage 28.

As the wellbore isolation device 200 is lowered into the wellbore 6, the spring 42 prevents the ball 26 from engaging the ball seat 30. As a result, fluids may pass through the wellbore isolation device 200; i.e., through the ports 46 and the central flow passage 28. The ball cage 22 retains the ball 26 such that it is not lost during translation into the wellbore 6 to its target location. Once the wellbore isolation device 200 reaches the target location, a setting tool (not shown) of a type known in the art can be used to move the wellbore isolation device 200 from its unset position (shown in FIG. 2) to a set position. The setting tool may operate via various mechanisms to anchor the wellbore isolation device 200 in the wellbore 6 including, but not limited to, hydraulic setting, mechanical setting, setting with well hydrostatic pressure, setting by swelling, setting by inflation, and the like.

In some embodiments, the wellbore isolation device 200 may incorporate a mechanism for setting the wellbore isolation device 200 in the wellbore 6. That is, the wellbore isolation device 200 may have a mechanism to move from the unset position (shown in FIG. 2) to the set position. A mechanism for setting the wellbore isolation device 200 may include a mechanical force generator, such as a compressed spring, a hydraulic force generator, such as an internal piston activated by surface pressure, a hydrostatic force generator, such as an internal piston with an atmospheric chamber, an electric motor conveyance, such as an electric motor with linear screw, or any combination of those methods. The setting mechanism on the wellbore isolation device 200 may be activated remotely from surface to move the wellbore isolation device 200 from the unset position to the set position.

The setting of the wellbore isolation device 200 moves the parts from the run-in position shown in FIG. 2, to the set or actuated position. The setting force generated by the setting tool (not shown) pushes against the slips 34A-B to move the slips 34A-B axially and radially up onto the ramped surface of the slip wedges 36 A-B to contact the wellbore 6. The slip wedges 36 A-B push against the sealing element 38 to compress and expand the sealing element 38 radially. The setting force applied to the sealing element 38 generates a contact stress against the wellbore 6. The applied setting force may sealingly engage the sealing elements 38 and cause the slips to grippingly engage the wellbore 6.

After the wellbore isolation device 200 is set, fluid pressure may be increased within the wellbore 6 to overcome the spring force of the spring 42 as the ball 26 is forced against the spring 42. Overcoming the spring force may allow the ball 26 to engage and seal against ball seat 30, and thereby prevent fluid communication through the central flow passage 28. With the ball 26 sealingly engaged with the ball seat 30, the fluids within the wellbore 6 may be forced to other areas of the wellbore or surrounding formation for one or more wellbore completion and/or stimulation operations. Following the wellbore completion and/or stimulation operation, the fluid pressure may be decreased within the wellbore 6, thereby allowing the spring 42 to remove the ball 26 from engagement with the ball seat 30.

As will be explained in greater detail in the following embodiments, the metal backup ring may support the sealing element 38 when the wellbore isolation device 200 is set in the wellbore 6. The setting force applied to the sealing element 38 radially expands the sealing element 38 into sealing engagement with the wellbore 6. The sealing element 38 spans the gap between the outside diameter of the wellbore isolation device 200 and the inside diameter of the wellbore 6. A wellbore annular pressure differential between the uphole annular fluid environment and the downhole annular fluid environment will cause the sealing element 38 to move from the high pressure side to the low pressure side. The uphole direction refers to the side of the sealing element 38 that is closest the surface wellhead. The downhole direction refers to the side of the sealing element 38 that faces the bottom of the wellbore. An increased annular pressure differential may cause the element material to move into the gap between the outside diameter of the wellbore isolation device 200 and the inside diameter of the wellbore 6. The sealing element 38 has been stressed by the compressive force applied by the setting mechanism to radially expand the sealing element 38 to the wellbore 6. The wellbore differential pressure between the uphole annulus and the downhole annulus increases the stress inside the sealing element 38. When the element material moves into the gap the stressed material becomes unsupported and begins to fail by extrusion where a small portion of the material tears off or extrudes through the gap. The metal backup ring may span the gap between the outside diameter of the wellbore isolation device 200 and the wellbore 6 to support the element material and prevent the sealing element 38 from moving into the gap.

Figure 3A:
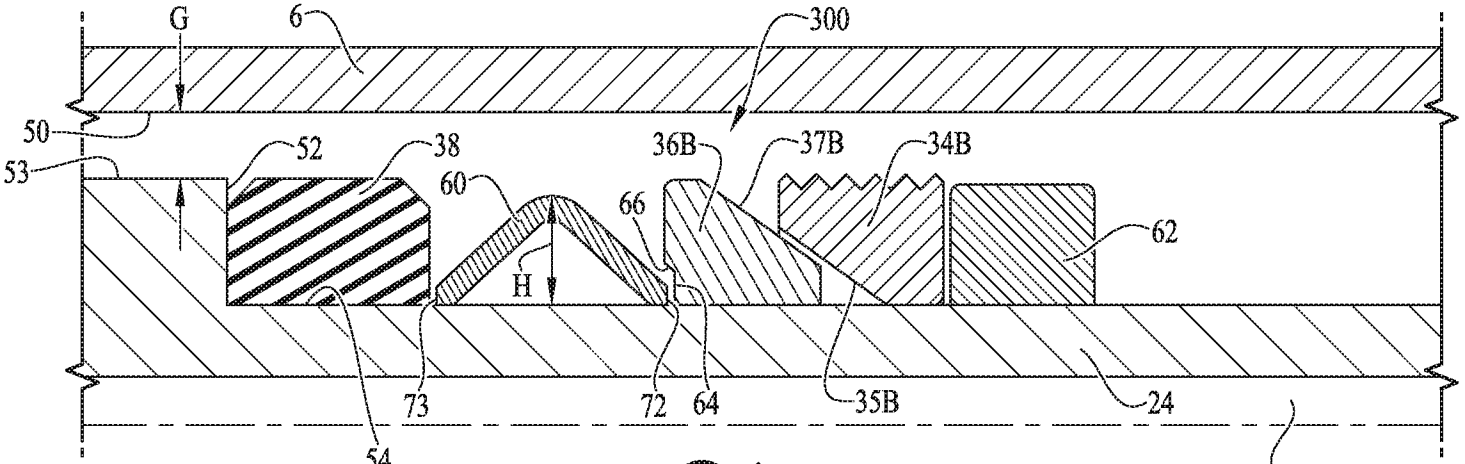
FIG. 3A-B is a cross-section view of an embodiment of a wellbore isolation device.

Turning now to FIG. 3A, an embodiment of the wellbore isolation device 300 comprises a sealing element 38, a metal backup ring 60, a lower slip wedge 36B, a lower slip 34B, and end ring 62. The sealing element 38 is installed onto the mandrel outer surface 54 of the mandrel 24 and abuts a mandrel shoulder 52. The sealing element 38 is shown as a single element, however two or three or any number of sealing elements may be utilized. The metal backup ring 60 slidingly fits onto the mandrel outer surface 54 to contact the sealing element 38 with the uphole end surface 73. The lower slip wedge 36B slidingly fits onto the mandrel outer surface 54 and contacts the metal backup ring 60 with an end surface 64. The lower slip 34B slidingly fits onto the mandrel outer surface 54 in connection with conical surface 37B with wedge inner surface 35B. End ring 62 slidingly fits onto outer surface of 54 of mandrel 24 to abut lower slip 34B. A radial gap G is measured between the mandrel outside diameter 53 and the inner surface 50 of the wellbore 6. The sealing element 38 and lower slip 34B span the radial gap G to contact the inner surface 50 of the wellbore 6 when the wellbore isolation device 300 is set in the wellbore.

Figure 4B:
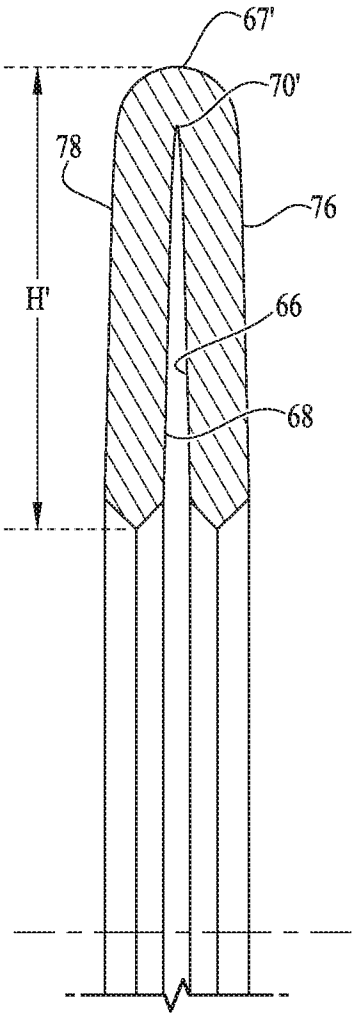
FIG. 4A-B is a cross-section view of an embodiment of a backup ring of a wellbore isolation device.
Figure 4A:
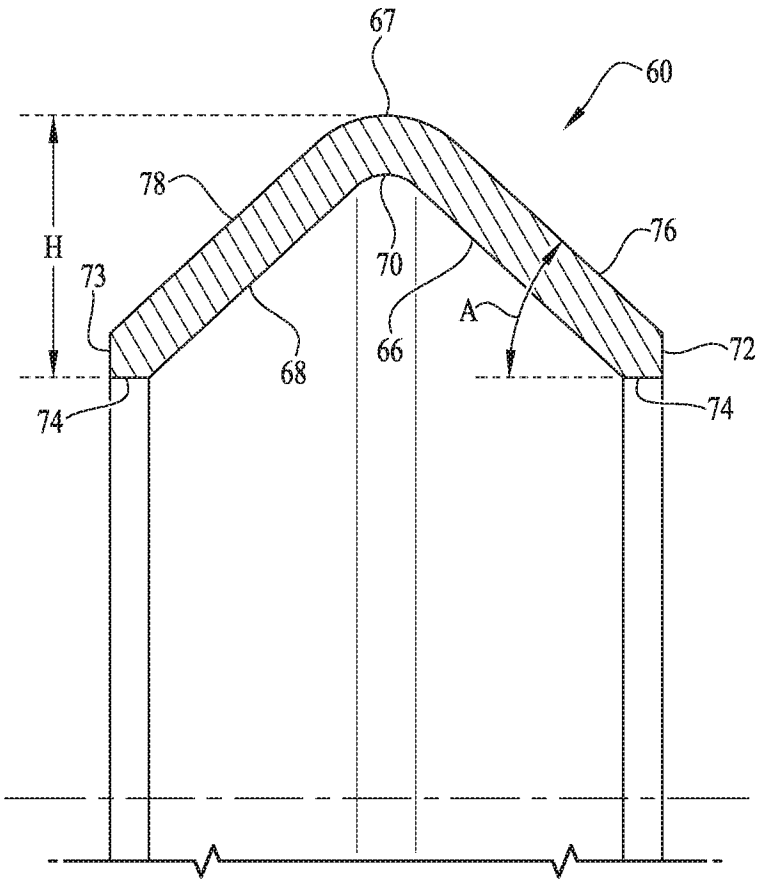

The metal backup ring 60, shown in greater detail in FIG. 4A, may have a generally inverted U-shape that slidingly fits onto the mandrel outer surface 54 and abuts the sealing element 38. The metal backup ring 60 may have an uphole outer leg surface 78 and a downhole outer leg surface 76. The uphole side would be the side that is closest to the surface wellhead along the axis of the metal backup ring 60 or the axis of the mandrel 24. Likewise, the downhole side would be the side that is closest to the bottom of the well along the axis of the part or the mandrel 24. The top radius 67 is the outside curve where the uphole outer leg surface 78 and downhole outer leg surface 76 meet. The height of the ring H is measured from the top radius 67 to the bottom edge 74 perpendicular to the bottom edge 74. The angle A measured between the uphole outer leg and the axis of the part is generally between 15 and 45 degrees. The uphole outer leg surface 78 and downhole outer leg surface 76 are generally equal in length and angle with the axis. The uphole inner leg surface 68 is the inside surface of the uphole leg. The downhole leg inner surface 66 is the inside surface of the inner leg.

The metal backup ring 60 may be composed of a degradable metal material that is a degradable alloy, wherein the degradable alloy is a magnesium alloy, and aluminum alloy, or a combination thereof. Other components of the frac plug may additionally be comprised of a degradable material, including any degradable metal material (e.g., a degradable alloy) or a degradable elastomer, such as the packer element, without departing from the scope of the present disclosure.

The metal backup ring 60 may be composed of a soft material that is millable or drillable for removal with a drill bit or mill such a brass alloy, bronze alloy, a magnesium alloy, and aluminum alloy, or a combination thereof. Other components of the frac plug may additionally be comprised of a millable or drillable material, including any soft metal materials (e.g., a brass alloy, aluminum alloy, or magnesium alloy) or a composite polymer material (e.g., Fiberglas, carbon fiber composites), without departing from the scope of the present disclosure.

The metal backup ring 60 may be reconfigured as shown in FIG. 4B after being expanded to the extended height H' with the uphole and downhole legs collapsed together. The setting force applied to the wellbore isolation device 300 is transferred to the metal backup ring 60 by the downhole end surface 72 and the uphole end surface 73. The downhole end surface 72 may contact the end ring 62, lower slip wedge 36B, sealing element 38, or a second metal backup ring 60 depending on the embodiment. The uphole end surface 73 may contact the mandrel shoulder 52, upper slip wedge 36A, sealing element 38, or a second metal backup ring 60 depending on the embodiment. The setting force applied with the connecting parts may be transferred from the downhole end surface 72 through the ring to the uphole end surface 73. The metal backup ring 60 will expand radially and deflect axially when the setting force exceeds the material yield strength. The metal backup ring 60 will expand radially from the initial height H in FIG. 4A to the expanded height H' in FIG. 4B. In the expanded state, the uphole inner leg surface 68 and the downhole leg inner surface 66 deflect towards the other and may come into contact with each other. The top radius 67 and bottom radius 70 may decrease in size or otherwise deflect with the radial change in height from H to H'. Although the increase in height is depicted as a free standing ring in FIG. 4B, it is understood that the radial change in height may be constrained by the inner surface 50 of the wellbore 6 so that the new height H' may be the radially expanded height formed to the inner surface 50 of the wellbore 6.

Figure 3B:
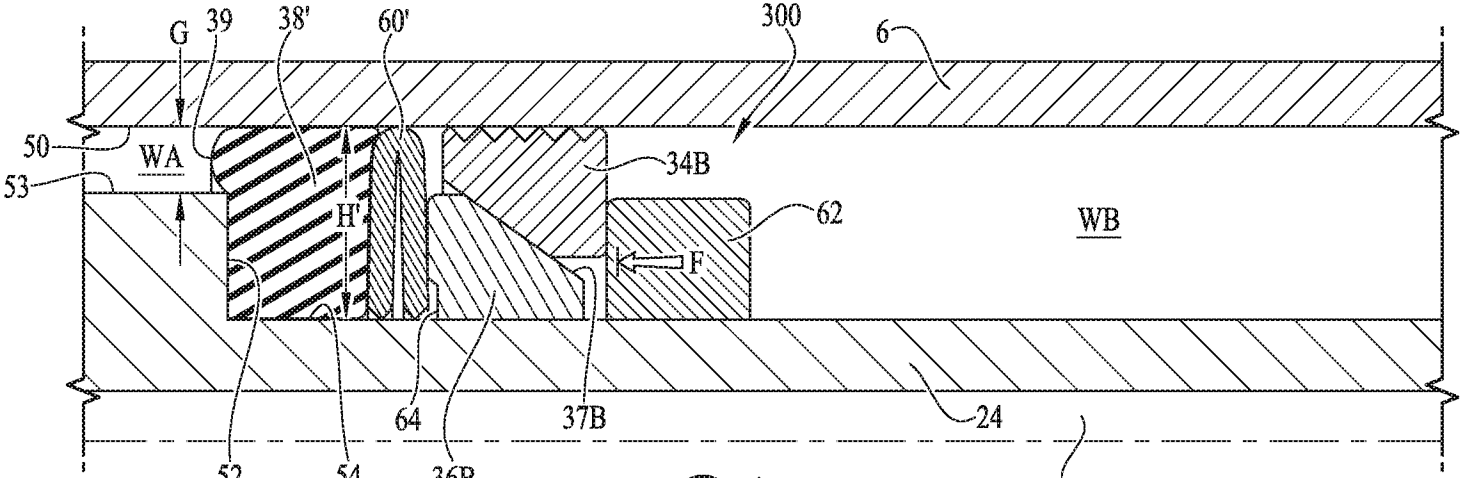

Turning now to FIG. 3B, sealing element 38' may be expanded by compressive force applied by a setting tool adapted to the wellbore isolation device 300. The setting tool supplies a compressive axial force F that may be transferred by an adapter kit (not shown) to the end ring 62. The axial force F is transferred through end ring 62, urging the lower slip 34B on the conical surface 37B of lower slip wedge 36B and into engagement with the inner surface 50 of the wellbore 6. The end ring 62 may retain the axial force F with a lock ring (not shown) that locks or fixes the position of the end ring 62 to the mandrel 24. The compressive axial force F transfers through the end surface 64 of lower slip wedge 36B to downhole end surface 72 of metal backup ring 60 and into metal backup ring 60, sealing element 38, and into mandrel shoulder 52. The axial force compresses the sealing element 38 between mandrel shoulder 52 and metal backup ring 60 into sealing contact with the casing inner surface 50. The axial force compresses the metal backup ring 60 between the sealing element 38 and end surface 64 on the lower slip wedge 36B, and expands the metal backup ring 60 into an expanded state. The engagement of the sealing elements 38 between the inner surface of the casing, the mandrel outer surface 54, the mandrel shoulder 52, and expanded metal backup ring 60' by axial force F may generate a high contact stress. As a result, the sealing elements 38 may provide a sealed engagement against the wellbore 6. The contact stress within the sealing element 38 may cause stressed element material 39 to move into the gap G between the mandrel outside diameter 53 and the inner surface 50 of the wellbore 6. The expanded sealing element 38' isolates the upper wellbore environment WA (pressure and fluid composition) from the downhole well environment WB (pressure and fluid composition).

In an embodiment, metal backup ring 60' may expand a percentage of the gap G. The metal backup ring 60 and sealing element 38 expands by compressive force applied by a setting tool adapted to the wellbore isolation device 300. The axial force compresses the sealing element 38 between mandrel shoulder 52 and metal backup ring 60 into sealing contact with the casing inner surface 50. The axial force compresses the metal backup ring 60 between the sealing element 38 and end surface 64 on the lower slip wedge 36B, and expands the metal backup ring 60 into an expanded state with extended height H' and the uphole and downhole legs collapsed together. The radial change in height from H to H' may expand 80% of the gap G but not contact the inner surface 50 of the wellbore 6. In an embodiment, the expanded height H' of the metal backup ring 60' may be within 0.09 inches from the inner surface 50 of the wellbore 6. In an embodiment, the expanded height H' of the metal backup ring 60' may abut the inner surface 50 of wellbore 6 in one or more locations, but not along the entire inner circumference. Although the radial change in height from H to H' may expand 80%, it is understood that the percentage may be any number between 80% to 100%. Although the expanded height H' may be 0.09 inches from the inner surface 50 of the wellbore 6, it is understood that the distance may be any number between 0.09 decreasing to zero.

The wellbore isolation device 300 shown in FIG. 3B isolates higher pressure from the uphole well environment WA from the downhole well environment WB. The higher pressure from the uphole well environment WA may move the stressed element material 39 of the sealing element 38 out of the gap G between the mandrel outside diameter 53 and the inner surface 50 of the wellbore 6 and in contact with the expanded metal backup ring 60'. The expanded metal backup ring 60' supports the sealing element 38 by filling the gap G and preventing the movement of unsupported sealing element 38. However, the element is not supported for high pressure from the opposite direction. That is, high pressure from the downhole environment WB may move stressed element material 39 of the sealing element 38 into the gap G between the outside diameter 53 and the inner surface 50. The stressed element material 39 may become unsupported and begin to tear off or extrude.

Figure 5A:
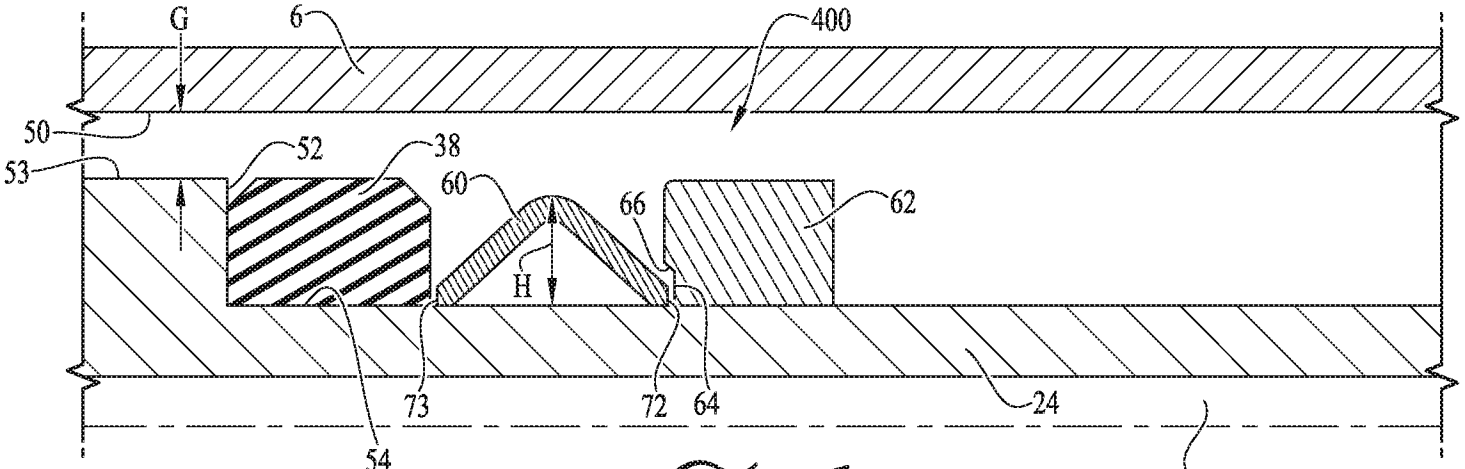
FIG. 5A-B is a cross-section view of an embodiment of a wellbore isolation device.

FIG. 5A is a cross-sectional view illustrating a preferred embodiment of the wellbore isolation device 400 comprising a sealing element 38, a metal backup ring 60, and end ring 62. The sealing element 38 is installed onto the mandrel outer surface 54 and abuts a mandrel shoulder 52. The metal backup ring 60 slidingly fits onto the mandrel outer surface 54 to contact the sealing element 38 with the uphole end surface 73. End ring 62 slidingly fits onto outer surface of 54 of mandrel and contacts the metal backup ring 60 with an end surface 64. A radial gap G is measured between the mandrel outside diameter 53 and the inner surface 50 of the wellbore 6.

Figure 5B:
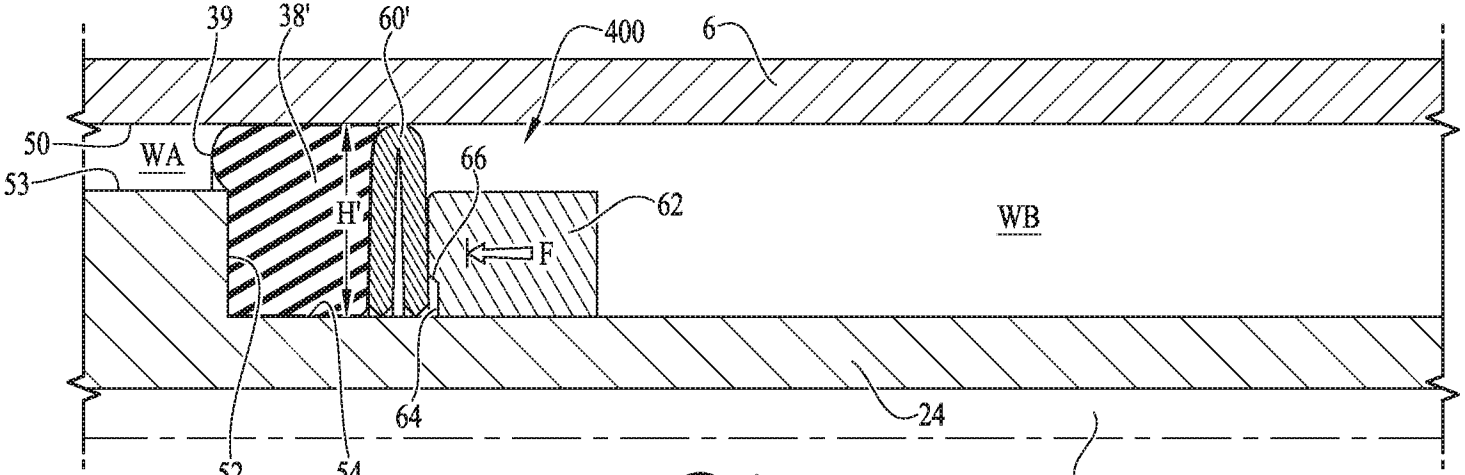

Turning now to FIG. 5B, sealing element 38 may be expanded by compressive force applied by a setting tool adapted to the wellbore isolation device 400. The setting tool supplies a compressive axial force F that may be transferred by an adapter kit (not shown) to the end ring 62. The axial force F is transferred through end ring 62 and into metal backup ring 60, sealing element 38, and into mandrel shoulder 52. The axial force compresses the sealing element 38 between mandrel shoulder 52 and metal backup ring 60 into sealing contact with the casing inner surface 50. The axial force compresses the metal backup ring between the sealing element 38 and end surface 64 on the end ring 62, and expands the metal backup ring 60 into an expanded state. The end ring 62 may retain the axial force F with a lock ring (not shown) that locks or fixes the position of the end ring 62 to the mandrel 24. The engagement of the sealing elements 38 between the inner surface of the casing, the mandrel outer surface 54, the mandrel shoulder 52, and expanded metal backup ring 60' by axial force F may generate a high contact stress. As a result, the sealing elements 38 may provide a sealed engagement against the wellbore 6. The contact stress within the sealing element 38 may cause stressed element material 39 to move into the gap G between the mandrel outside diameter 53 and the inner surface 50 of the wellbore 6. The expanded sealing element 38' isolates the upper wellbore environment WA (pressure and fluid composition) from the downhole well environment WB (pressure and fluid composition).

Figure 6:
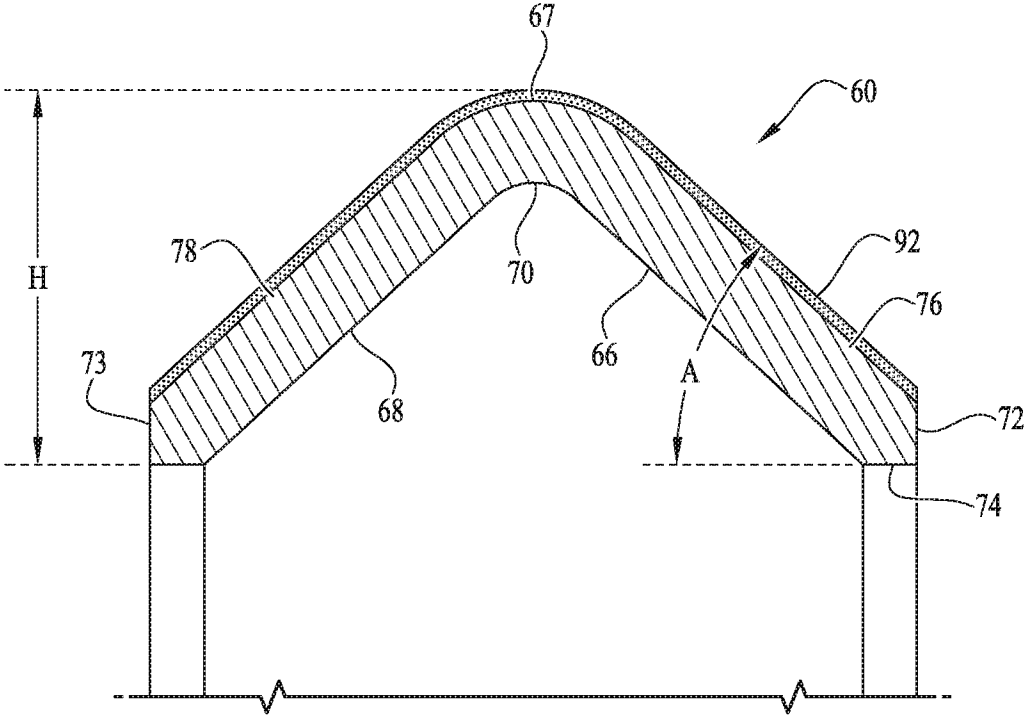
FIG. 6 is a cross-section view of an embodiment of a backup ring of a wellbore isolation device.

The expanded metal backup ring 60 may anchor the wellbore isolation device 400 to the inner surface 50 of the wellbore 6. An alternate embodiment of the expanded metal backup ring 60 is shown in FIG. 6. The outside surface may have an abrasive grit coating 92 on all or a portion of the outside surface. The grit may be comprised of carbide particles such as tungsten carbide, ceramic particles such as sintered bauxite or alumina, or other suitable high strength particle. The grit may be sized from 37 to 400 microns. The abrasive grit coating 92 may be applied by a plasma spray of metal or an epoxy resin. When the metal backup ring 60 expands and contacts the inner surface 50 of the wellbore 6, the grit may be pressed by the material of the metal backup ring 60' into the material of the inner surface 50 of the wellbore 6. The grit may penetrate the wellbore material surface up to 400 microns. The grit in combination with the contract stress between the expanded metal backup ring 60' and the inner surface 50 of the wellbore 6 may anchor the wellbore isolation device 400 to a location in the wellbore 6.

Figure 7A:
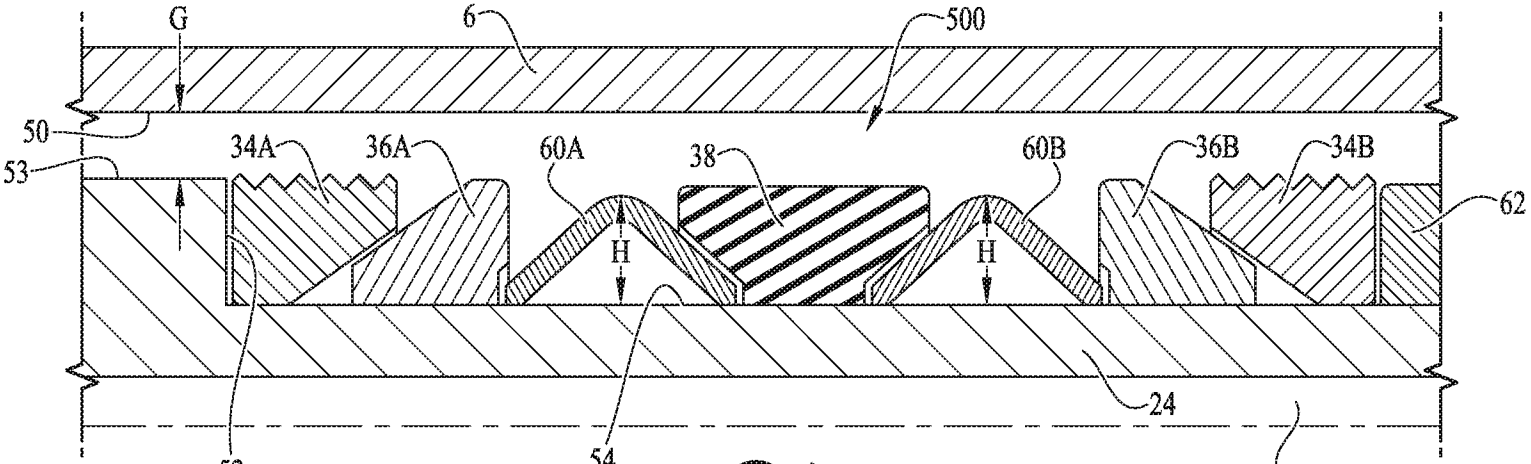
FIG. 7A-B is a cross-section view of an embodiment of a wellbore isolation device.

FIG. 7A is a cross-sectional view illustrating an embodiment of the wellbore isolation device 500 comprising an upper slip 34A, upper slip wedge 36A, metal backup ring 60A, sealing element 38, a metal backup ring 60B, lower slip wedge 36B, lower slip 34 B, and end ring 62. The upper slip 34A and upper slip wedge 36A may be installed onto mandrel 24 with the upper slip 34A abutting the mandrel shoulder 52. A metal backup ring 60A, the sealing element 38, and metal backup ring 60B may be installed onto the mandrel 24 with the metal backup ring 60A in contact with the upper slip wedge 36A. The lower slip wedge 36B, lower slip 34B and end ring 62 may be installed with the end surface 64 of the lower slip wedge 36B in contact with downhole end surface 72 of metal backup ring 60B. The metal backup ring 60A may be bonded to the uphole side of the sealing element 38. The metal backup ring 60B may be bonded to the downhole side of the sealing element 38. The metal backup ring 60B, sealing element 38, and lower metal backup ring 60B slidingly fits onto the mandrel outer surface 54. A radial gap G is measured between the mandrel outside diameter 53 and the inner surface 50 of the wellbore 6.

Figure 7B:
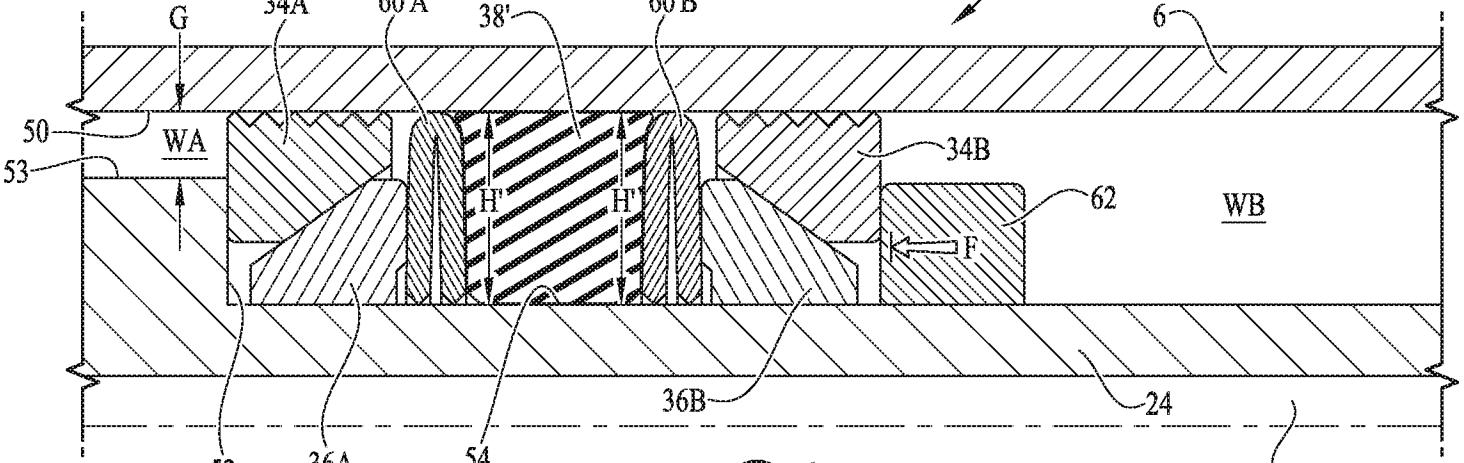

Turning now to FIG. 7B, sealing element 38 may be radially expanded into sealing engagement by compressive force applied by a setting tool adapted to the wellbore isolation device 500. The setting tool supplies a compressive axial force F that may be transferred by an adapter kit (not shown) to the end ring 62. The axial force F is transferred through end ring 62 to radially expand the upper slip 34A onto upper slip wedge 36A and to grip the inner surface 50 of the wellbore 6. The compressive axial force F expands the metal backup ring 60A, the sealing element 38, and the metal backup ring 60B into engagement with the inner surface 50 of the wellbore 6. The axial force F expands the lower slip 34B onto lower slip wedge 36B and moves the end ring 62 into contact with the lower slip 34B. The metal backup ring 60A, the sealing element 38, and the metal backup ring 60B may be expanded into sealing engagement with the wellbore 6. The end ring 62 may retain the axial force F with a lock ring (not shown) that locks or fixes the position of the end ring 62 to the mandrel 24. The engagement of the sealing element 38 between the inner surface of the casing, the mandrel outer surface 54, the expanded metal backup ring 60'A, and expanded metal backup ring 60'B by axial force F may generate a high contact stress, and as a result, the sealing elements 38 may provide a sealed engagement against the wellbore 6. The expanded sealing element 38 isolates the upper wellbore environment WA (pressure and fluid composition) from the downhole well environment WB (pressure and fluid composition). The expanded metal backup rings 60'A and 60'B may be sealed against the wellbore 6. The expanded metal backup rings 60'A and 60'B may have a grit coating and anchor to the inner surface 50 of the wellbore 6.

Figure 8A:
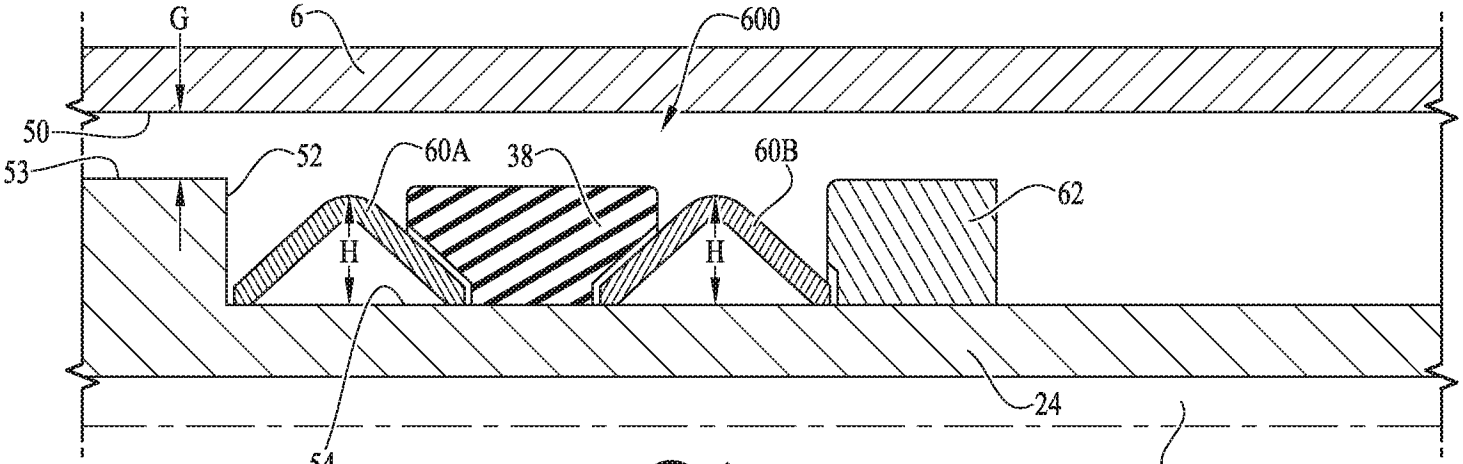
FIG. 8A-B is a cross-section view of an embodiment of a wellbore isolation device.

FIG. 8A is a cross-sectional view illustrating an embodiment of the wellbore isolation device 600 comprising a metal backup ring 60A, sealing element 38, a metal backup ring 60B, and end ring 62. The metal backup ring 60A, sealing element 38, metal backup ring 60B and end ring 62 are installed onto mandrel 24 with the metal backup ring 60A abutting the mandrel shoulder 52. The metal backup ring 60A may be bonded to the uphole side of the sealing element 38 and the metal backup ring 60B may be bonded to the downhole side of the sealing element 38. The metal backup ring 60B, sealing element 38, and lower metal backup ring 60B slidingly fits onto the mandrel outer surface 54. A radial gap G is measured between the mandrel outside diameter 53 and the inner surface 50 of the wellbore 6.

Figure 8B:
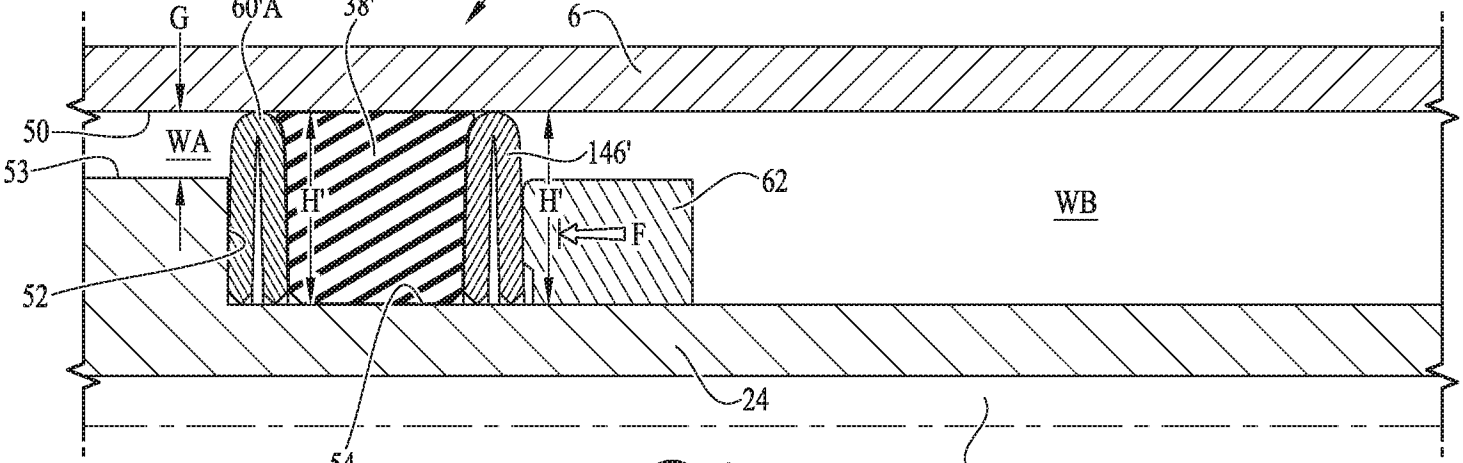

Turning now to FIG. 8B, sealing element 38 may be radially expanded into sealing engagement by compressive force applied by a setting tool adapted to the wellbore isolation device 600. The setting tool supplies a compressive axial force F that may be transferred by an adapter kit (not shown) to the end ring 62. The axial force F expands the metal backup ring 60A, the sealing element 38, and the metal backup ring 60B into engagement with the inner surface 50 of the wellbore 6. The end ring 62 may retain the axial force F with a lock ring (not shown) that locks or fixes the position of the end ring 62 to the mandrel 24. The engagement of the sealing element 38' between the inner surface of the casing, the mandrel outer surface 54, the expanded metal backup ring 60'A, and expanded metal backup ring 60'B by axial force F may generate a high contact stress, and as a result, the sealing elements 38' may provide a sealed engagement against the wellbore 6. The expanded sealing element 38' isolates the upper wellbore environment WA (pressure and fluid composition) from the downhole well environment WB (pressure and fluid composition). The expanded metal backup rings 60'A and 60'B may be in sealing contact against the wellbore 6. The expanded metal backup rings 60'A and 60'B may have a grit coating and anchor to the inner surface 50 of the wellbore 6.

Figure 9A:
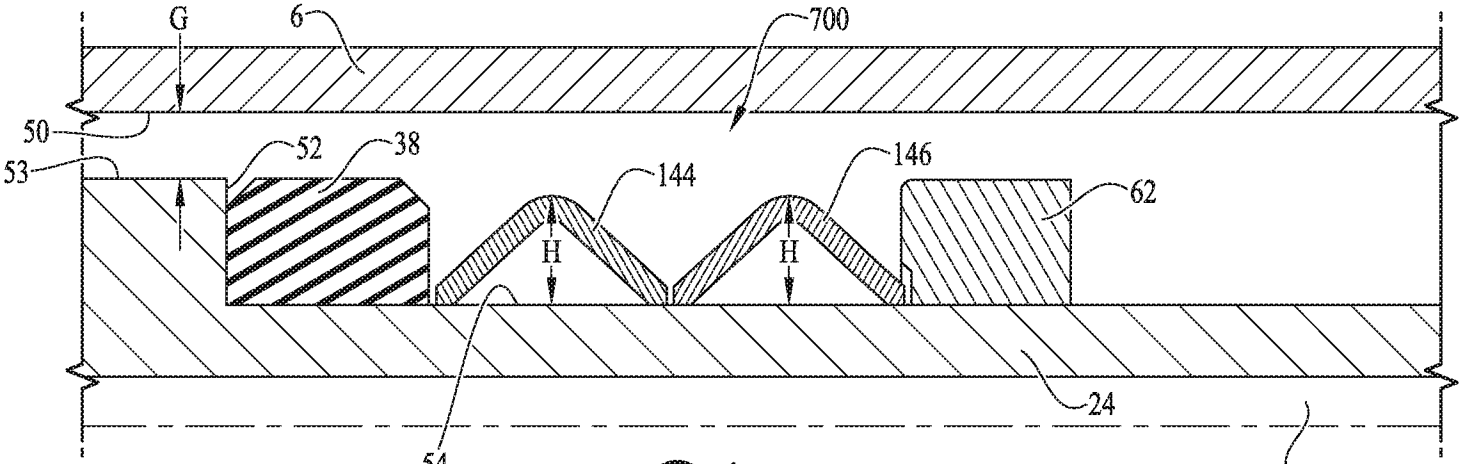
FIG. 9A-B is a cross-section view of an embodiment of a wellbore isolation device.

FIG. 9A is a cross-sectional view illustrating an embodiment of the wellbore isolation device 700 comprising sealing element 38, a metal backup ring 144, a metal backup ring 146, and end ring 62. The sealing element 38, metal backup ring 144, metal backup ring 146 and end ring 62 slidingly fits onto mandrel outer surface 54 of mandrel 24 with the sealing element 38 abutting the mandrel shoulder 52. The metal backup ring 144 may be bonded to the downhole side of the sealing element 38. A radial gap G is measured between the mandrel outside diameter 53 and the inner surface 50 of the wellbore 6.

Figure 9B:
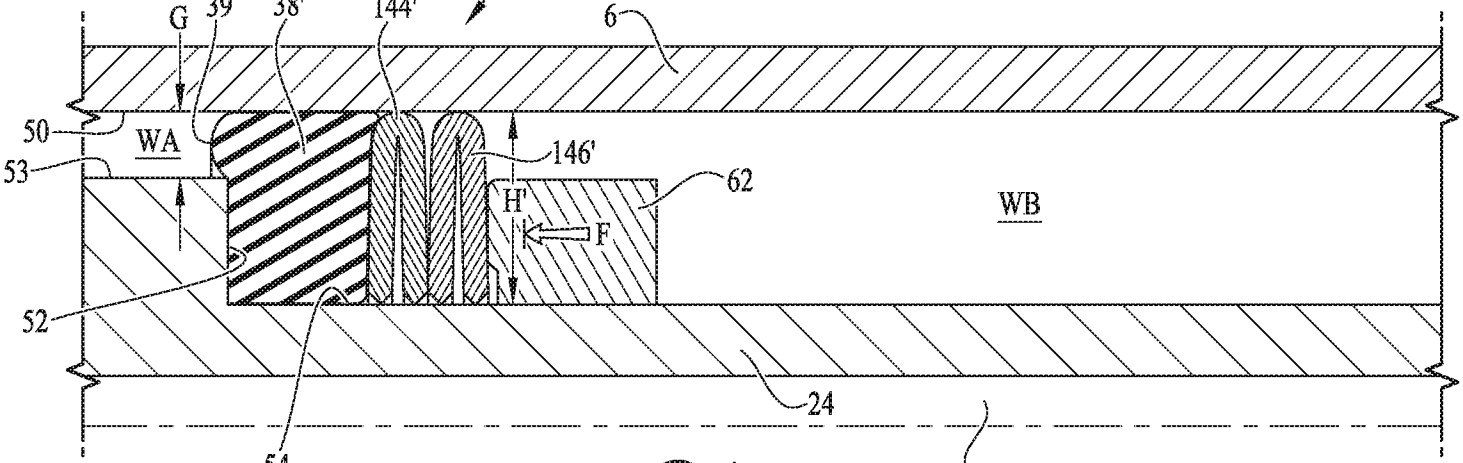

Turning now to FIG. 9B, sealing element 38 may be radially expanded into sealing engagement by compressive force applied by a setting tool adapted to the wellbore isolation device 700. The setting tool supplies a compressive axial force F that may be transferred by an adapter kit (not shown) to the end ring 62. The axial force F expands the sealing element 38, the metal backup ring 144, and the metal backup ring 146 into engagement with the inner surface 50 of the wellbore 6. The sealing element 38, the metal backup ring 144 and the metal backup ring 146 may be expanded into sealing engagement with the wellbore 6. The end ring 62 may retain the axial force F with a lock ring (not shown) that locks or fixes the position of the end ring 62 to the mandrel 24. The engagement of the sealing element 38' between the inner surface of the casing, the mandrel outer surface 54, and expanded metal backup ring 144' by axial force F may generate a high contact stress, and as a result, the sealing elements 38' may provide a sealed engagement against the wellbore 6. The expanded sealing element 38' isolates the upper wellbore environment WA (pressure and fluid composition) from the downhole well environment WB (pressure and fluid composition). The expanded metal backup rings 144' and 146' may be in sealing contact against the wellbore 6. The expanded metal backup rings 144' and 146' may have a grit coating and anchor the wellbore isolation device 700 to the inner surface 50 of the wellbore 6.

Figure 10A:
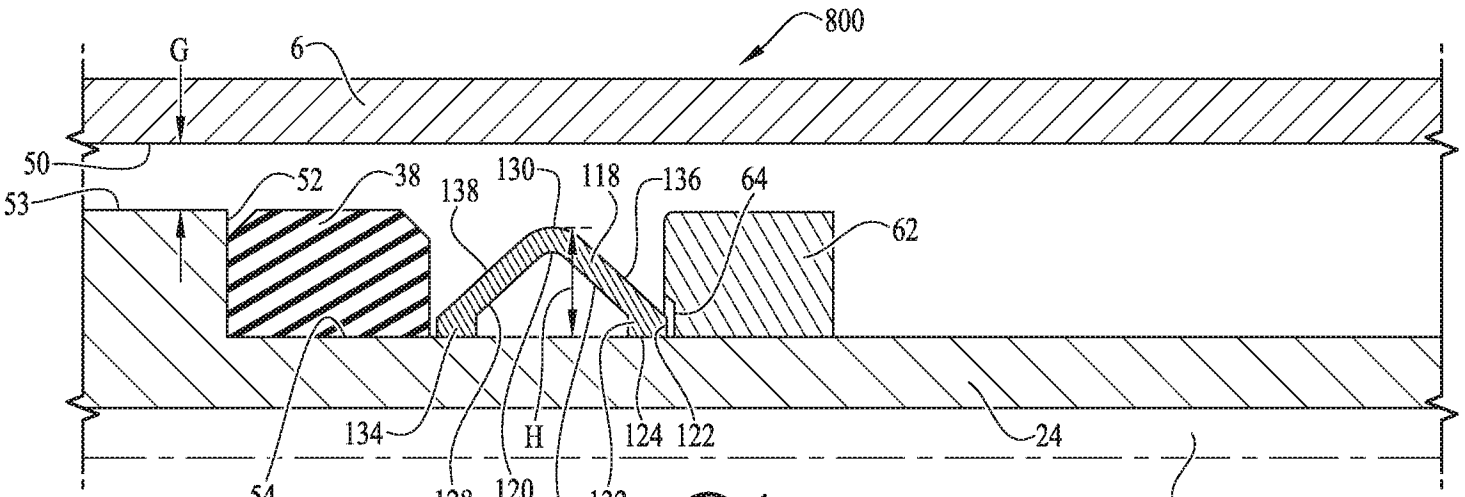
FIG. 10A-B is a cross-section view of an embodiment of a wellbore isolation device.

FIG. 10A is a cross-sectional view illustrating an embodiment of the wellbore isolation device 800 comprising a sealing element 38, a metal backup ring 118, and end ring 62. The sealing element 38 is installed onto the mandrel outer surface 54 and abuts a mandrel shoulder 52. The metal backup ring 118 slidingly fits onto the mandrel outer surface 54 of the mandrel 24 to contact the sealing element 38 with the end surface 122. The metal backup ring 118 has a downhole outer leg surface 136 and an uphole outer leg surface 138 that meet at top radius 130. The metal backup ring 118 has an initial height H measured from the top radius 130 to the bottom surface 124. The metal backup ring 118 has a downhole inner leg surface 126 and an uphole inner leg surface 128 that meet at bottom radius 120. The uphole inner leg surface 128 has uphole inner protrusion 134 that extends inwards towards downhole inner leg surface 126. The downhole inner leg surface 126 has a downhole inner protrusion 132 that extends inwards towards uphole inner leg surface 128. End ring 62 slidingly fits onto outer surface of 54 of mandrel and contacts the metal backup ring 118 with an end surface 64. A radial gap G is measured between the mandrel outside diameter 53 and the inner surface 50 of the wellbore 6.

Figure 10B:
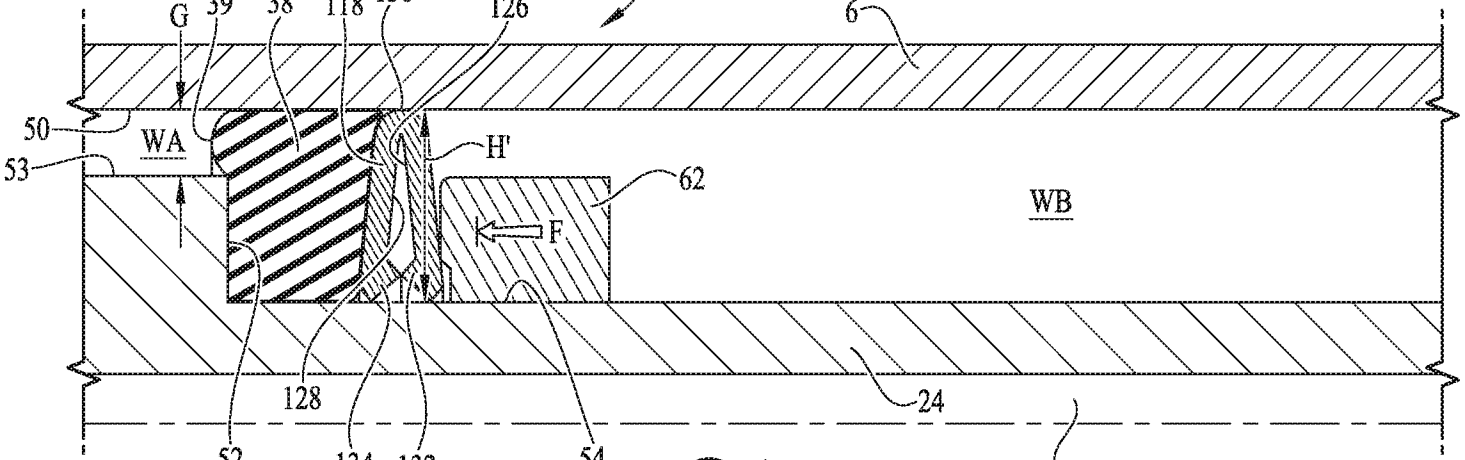

Turning now to FIG. 10B, sealing element 38 may be expanded by compressive force applied by a setting tool adapted to the wellbore isolation device 800. The setting tool supplies a compressive axial force F that may be transferred by an adapter kit (not shown) to the end ring 62. The axial force F is transferred through end ring 62 and into metal backup ring 118, sealing element 38, and into mandrel shoulder 52. The axial force compresses the sealing element 38 between mandrel shoulder 52 and metal backup ring 118 into sealing contact with the inner surface 50 of the wellbore 6. The axial force compresses the metal backup ring 118 between the sealing element 38 and end surface 64 on the end ring 62, and expands the metal backup ring 118 into an expanded state with expanded height H'. The expanded height H' is measured from the top radius 130' to the mandrel outer surface 54. The metal backup ring 118 axially deforms so that the downhole inner protrusion 132 contacts the uphole inner protrusion 134. The axial deflection of the metal backup ring 118 may be limited so that the uphole inner leg surface 128 may approach but not contact downhole inner leg surface 126. The end ring 62 may retain the axial force F with a lock ring (not shown) that locks or fixes the position of the end ring 62 to the mandrel 24. The engagement of the sealing elements 38' between the inner surface of the casing, the mandrel outer surface 54, the mandrel shoulder 52, and expanded metal backup ring 60' by axial force F may generate a high contact stress. As a result, the sealing elements 38' may provide a sealed engagement against the wellbore 6. The contact stress within the sealing element 38' may cause stressed element material 39 to move into the gap G between the mandrel outside diameter 53 and the inner surface 50 of the wellbore 6. The expanded sealing element 38 isolates the upper wellbore environment WA (pressure and fluid composition) from the downhole well environment WB (pressure and fluid composition).

Figure 11A:
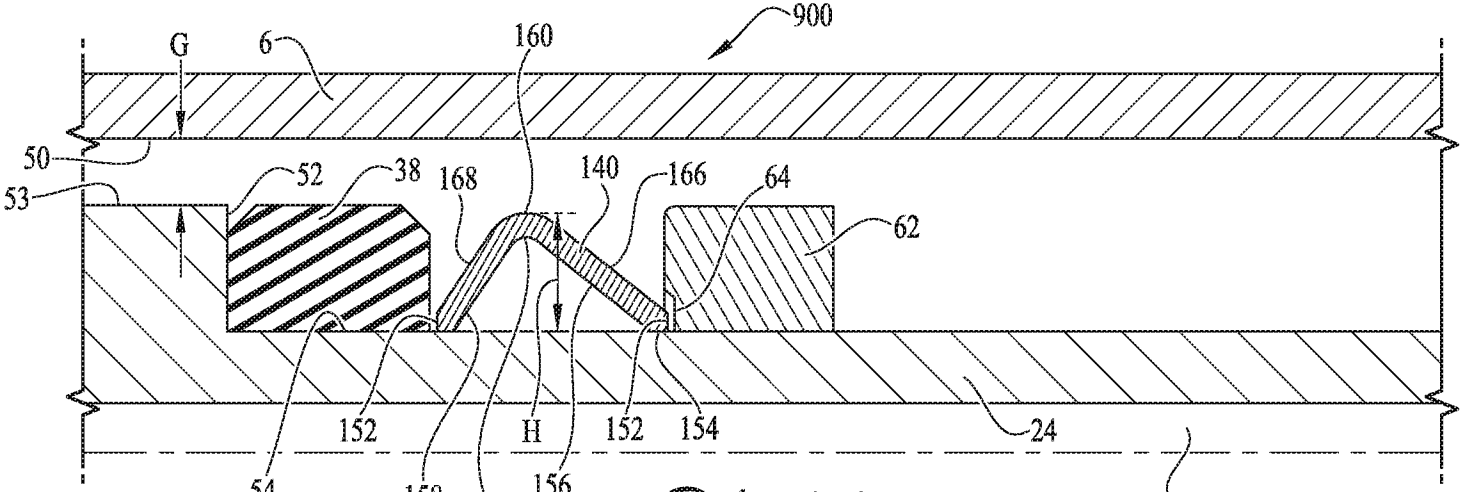
FIG. 11A-B is a cross-section view of an embodiment of a wellbore isolation device.

FIG. 11A is a cross-sectional view illustrating an embodiment of the wellbore isolation device 900 comprising a sealing element 38, a metal backup ring 140, and end ring 62. The sealing element 38 is installed onto the mandrel outer surface 54 and abuts a mandrel shoulder 52. The metal backup ring 140 slidingly fits onto the mandrel outer surface 54 to contact the sealing element 38 with the end surface 152. The metal backup ring 140 has a downhole outer leg surface 166 and an uphole outer leg surface 168 that meet at top radius 160. The metal backup ring 140 has an initial height H measured from the top radius 160 to the bottom surface 154. The metal backup ring 140 has a downhole inner leg surface 156 and an uphole inner leg surface 158 that meet at bottom radius 150. The downhole outer leg surface 166 may be longer than uphole outer leg surface 168 the angle between the uphole inner leg surface 158 and the mandrel outer surface 54 may be greater than the angle between the downhole inner leg surface 156 and the mandrel outer surface 54. The difference in length between the uphole leg and the downhole leg may allow the shorter leg, the uphole leg, to deflect or deform before the longer leg which is the downhole leg. End ring 62 slidingly fits onto outer surface of 54 of mandrel and contacts the metal backup ring 118 with an end surface 64. A radial gap G is measured between the mandrel outside diameter 53 and the inner surface 50 of the wellbore 6.

Figure 11B:
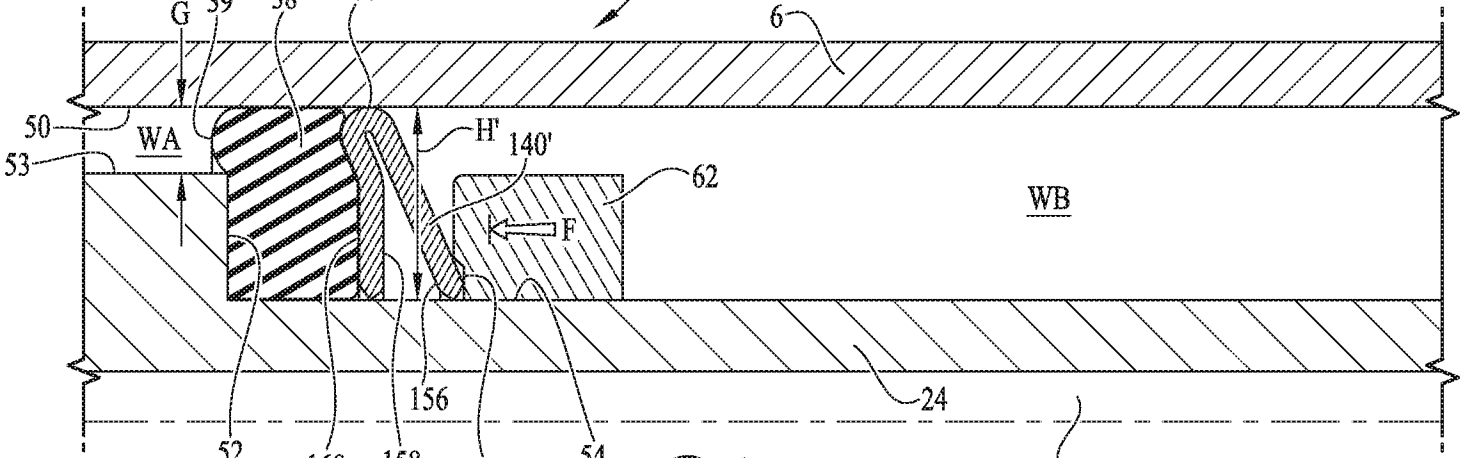

Turning now to FIG. 11B, sealing element 38 may be expanded by compressive force applied by a setting tool adapted to the wellbore isolation device 900. The setting tool supplies a compressive axial force F that may be transferred by an adapter kit (not shown) to the end ring 62. The axial force F is transferred through end ring 62 and into metal backup ring 140, sealing element 38, and into mandrel shoulder 52. The axial force compresses the sealing element 38 between mandrel shoulder 52 and metal backup ring 140 into sealing contact with the inner surface 50 of the wellbore 6. The axial force compresses the metal backup ring 140 between the sealing element 38 and end surface 64 on the end ring 62, and expands the metal backup ring 140 into an expanded state with an expanded height H'. The expanded height H' is measured from the top radius 160' to the mandrel outer surface 54. The metal backup ring 140 axially deforms so that the shorter leg, the uphole outer leg surface 168, contacts the sealing element 38 first before the longer leg, downhole outer leg surface 166 expands the top radius 160' into engagement with the inner surface 50 of the wellbore 6. The longer leg of the metal backup ring 140 may stop axial deformation and radial expansion of the backup ring when the top radius 160' contacts the wellbore 6 by wedging the downhole outer leg surface 166 between the inner surface 50 of the wellbore 6 and the mandrel outer surface 54. The end ring 62 may retain the axial force F with a lock ring (not shown) that locks or fixes the position of the end ring 62 to the mandrel 24. The engagement of the sealing elements 38 between the inner surface of the casing, the mandrel outer surface 54, the mandrel shoulder 52, and expanded metal backup ring 140' by axial force F may generate a high contact stress. As a result, the sealing elements 38' may provide a sealed engagement against the wellbore 6. The contact stress within the sealing element 38' may cause stressed element material 39 to move into the gap G between the mandrel outside diameter 53 and the inner surface 50 of the wellbore 6. The expanded sealing element 38 isolates the upper wellbore environment WA (pressure and fluid composition) from the downhole well environment WB (pressure and fluid composition).

Figure 12:
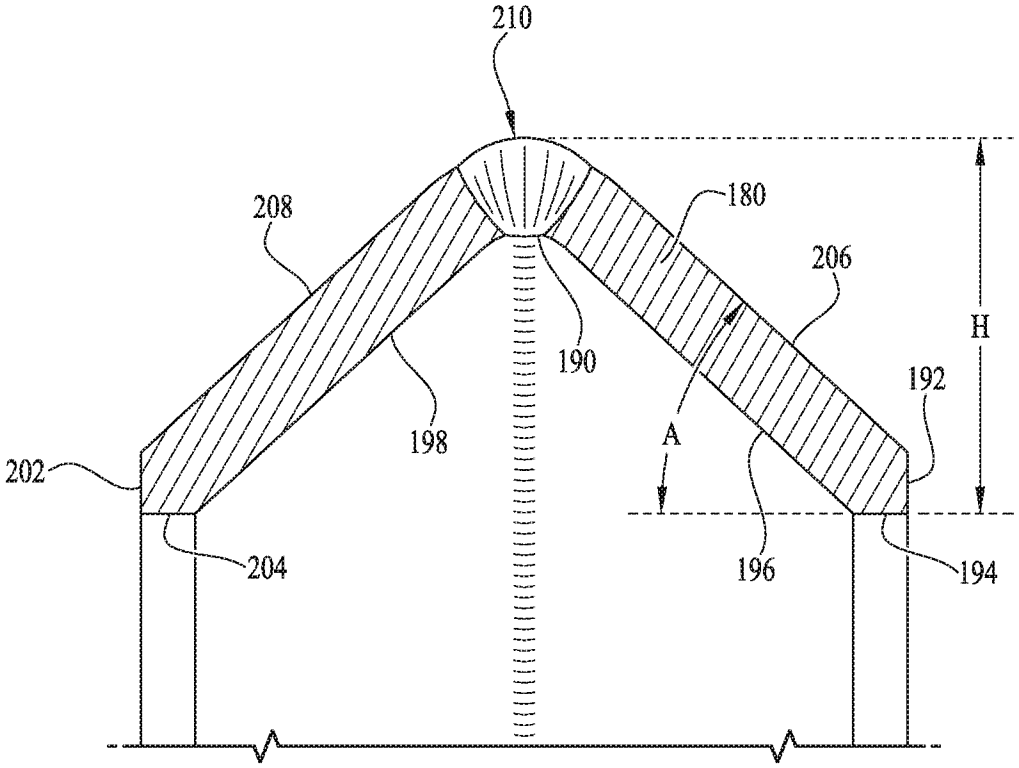
FIG. 12 is a cross-section view of an embodiment of a backup ring of a wellbore isolation device.

Turning now to FIG. 12, an alternate embodiment of the metal backup ring 180 is disclosed. The uphole leg and downhole leg the metal backup ring 180 may be manufactured separately and joined together at the top radius 210 by mechanical joining, welding operation, chemical binder, or similar joining methods to form a generally inverted U-shape or inverted V-shaped cross-section. Mechanical joining refers to any method, threads or fasteners, to join or attach the uphole leg to the downhole leg. A welding procedure generally refers to joining the uphole leg and downhole leg with an electrode that applies a flux of material in response to an electrical current applied through the parts. The chemical binder generally refers to any method to glue the uphole leg and downhole leg together. The uphole leg and downhole leg may be frustoconical in shape with straight edges. In an embodiment, the uphole leg and downhole leg may have curved sides. In an embodiment, the angle A formed between each outer surface and the mandrel outer surface 54 may be generally between 15 and 45 degrees. The metal backup ring 180 has a downhole outer leg surface 206 and an uphole outer leg surface 208 that meet where the two parts are welded or bonded at the top radius 210. The metal backup ring 200 has an initial height H measured from the top radius 210 to the bottom surface 194. The metal backup ring 180 has a downhole inner leg surface 196 and an uphole inner leg surface 198 that meet at bottom radius 190. The bottom surface 194 of the downhole leg and the bottom surface 204 of the uphole leg have a sliding fit, a fit that allows movement, with the mandrel outer surface 54. Each leg of the metal backup ring may be machined, pressed, sintered, forged, molded, or manufactured utilizing an additive manufacturing process. The downhole leg of the metal backup ring 180 has an end surface 192 that is generally flat and vertical and a bottom surface 194 that is generally parallel to the mandrel outer surface 54. The uphole leg of the metal backup ring 180 has an end surface 202 that is generally flat and vertical and a bottom surface 204 that is generally parallel to the mandrel outer surface 54. The metal backup ring 180 may have an allowance fit that slidingly engages to the mandrel outer surface 54. The metal backup ring 180 may have an uphole outer leg surface 208 and a downhole outer leg surface 206 that are generally equivalent in length. An embodiment of the metal backup ring 180 may have one side longer than the other. An embodiment of the metal backup ring 180 may have a coating of grit on all or part of the outside surface.

Referring again to FIG. 1, with continued reference to the other figures discussed herein, the wellbore isolation device 16 may be conveyed into a well on wireline, coil tubing, tubing, or drill pipe for completion or stimulation operations. The wellbore isolation device 16 may be attached to a setting tool or may have a means to actuate incorporated within. The wellbore isolation device 16 is set within the wellbore 6 to isolate the uphole well environment from the downhole well environment. In some cases the wellbore isolation device 16 is a packer with a central flow passage 28. In other cases, the wellbore isolation device 16 is a bridge plug with a blocked central flow passage 28. In other cases, the wellbore isolation device 16 is a frac plug with a valve on the central flow passage 28 that allows flow from one direction, but blocks flow from the opposite direction.

The wellbore isolation device 16 may have one or more metal backup rings 60 that radially expand to support the sealing element 38 that radially expand to seal to the inner surface 50 of the wellbore 6. The wellbore isolation device 16 may be activated by a compressive force applied by a setting tool or by a setting mechanism integrated within. When the wellbore isolation device 16 is positioned in a location proximate to a zone of interest, a compressive force is applied to the wellbore isolation device 16 a setting tool or setting mechanism integrated within.

In an embodiment shown with wellbore isolation device 300, the compressive axial force F moves the lower slip 34B onto the conical surface 37B of the lower slip wedge 36B and into radial engagement with the inner surface 50 of the wellbore 6 to anchor to the wellbore 6. The compressive axial force F compresses the sealing element 38 and metal backup ring 60 between the lower slip wedge 36B and the mandrel shoulder 52 to radially expand the sealing element 38 and metal backup ring 60 to contact the inner surface 50 of the wellbore 6. The metal backup ring 60 deforms axially with the downhole leg inner surface 66 moving proximate to the uphole leg inner surface 68 as the top radius 67 expands radially from the initial height H to the expanded height H'. The expanded metal backup ring 60' support the expanded sealing element 38 to prevent sealing element material from moving past the expanded metal backup ring 60'. The metal backup ring 60 may contact the inner surface 50 of the wellbore 6 with no contact stress or with a stress level sufficient to provide a sealing engagement against the wellbore 6. In the first embodiment, the lower slips 34B anchor the wellbore isolation device 16 to the wellbore 6, the sealing elements 38 seal the wellbore isolation device 16 to the wellbore 6, and the metal backup ring 60 supports the sealing element 38 to prevent sealing element material from moving past the metal backup ring 60. The wellbore isolation device 16 isolates the wellbore environment from one direction; that is, the uphole side to the downhole side, but not the downhole side to the uphole side.

In another embodiment shown with wellbore isolation device 400, the compressive axial force F moves the sealing element 38 and metal backup ring 60 between the end ring 62 and the mandrel shoulder 52 to radially expand the sealing element 38 and metal backup ring 60 to contact the inner surface 50 of the wellbore 6. The metal backup ring 60 deforms axially with the downhole leg inner surface 66 moving proximate to the uphole leg inner surface 68 as the top radius 67 expands radially from the initial height H to the expanded height H'. The expanded metal backup ring 60' supports the expanded sealing element 38 to prevent sealing element material from moving past the expanded metal backup ring 60'. In an alternate embodiment, the metal backup ring 60 may have a coating with abrasive girt 92 applied to all or part of the outside surface. The metal backup ring 60 may contact the inner surface 50 of the wellbore 6 with no contact stress or with a stress level sufficient to provide a sealing engagement against the wellbore 6 or with a stress level sufficient to trap the abrasive grit between the expanded metal backup ring 60 and the inner surface 50 of the wellbore 6 to anchor the wellbore isolation device 400 to the wellbore 6. The wellbore isolation device 200 isolates the wcllbore environment from one direction; that is, the uphole side to the downhole side, but not the downhole side to the uphole side.

In the another embodiment shown with wellbore isolation device 500, the compressive axial force F moves the lower slip 34B onto the conical surface 37B of the lower slip wedge 36B and into radial engagement with the inner surface 50 of the wellbore 6 to anchor the wellbore isolation device 300 to the wellbore. The compressive axial force F compresses the sealing element 38 between metal backup ring 60A and metal backup ring 60B to radially expand the sealing element 38 and metal backup ring 60A and metal backup ring 60 B to contact the inner surface 50 of the wellbore 6 by transferring the axial force F through the lower slip wedge 36B. The upper slip 34A moves onto the conical surface 37A of the upper slip wedge 36A and into radial engagement with the inner surface 50 of the wellbore 6 as the axial force F compresses the upper slip 34A between the mandrel shoulder 52 and the metal backup ring 60A. The metal backup rings 60A and 60B deform axially with the downhole leg inner surface 66 moving proximate to the uphole leg inner surface 68 as the top radius 67 expands radially from the initial height H to the expanded height H'.

The expanded metal backup rings 60A' and 60B' support the expanded sealing element 38 to prevent sealing element material from moving past the expanded metal backup ring 60A' and 60B'. The metal backup ring 60A' and 60B' may contact the inner surface 50 of the wellbore 6 with no contact stress or with a stress level sufficient to provide a sealing engagement against the wellbore 6. In an embodiment, the upper slips 34A and the lower slips 34B anchor the wellbore isolation device 16 to the wellbore 6, the sealing elements 38 seal the wellbore isolation device 16 to the wellbore 6, and the metal backup rings 60A and 60B supports the sealing element 38 to prevent sealing element material from moving past the metal backup rings 60A and 60B. The wellbore isolation device 16 isolates the wellbore environment from both directions; that is, the uphole side to the downhole side and the downhole side to the uphole side.

In the another embodiment shown with wellbore isolation device 600, the compressive axial force F compresses the sealing element 38 between metal backup ring 60A and metal backup ring 60B to radially expand the sealing element 38 and metal backup ring 60A and metal backup ring 60 B to contact the inner surface 50 of the wellbore 6. The axial force F is transferred from the end ring 62 to the metal backup ring 60B to the sealing element 38, to the metal backup ring 60A, and into the mandrel shoulder 52. The metal backup rings 60A and 60B deform axially with the downhole leg inner surface 66 moving proximate to the uphole leg inner surface 68 as the top radius 67 expands radially from the initial height H to the expanded height H'. The expanded metal backup rings 60A' and 60B' support the expanded sealing element 38 to prevent sealing element material from moving past the expanded metal backup ring 60A' and 60B'. The metal backup ring 60A' and 60B' may contact the inner surface 50 of the wellbore 6 with no contact stress, with a stress level sufficient to provide a sealing engagement against the wellbore 6. In an alternate embodiment, the metal backup ring 60 may have an abrasive grit coating 92 applied to all or part of the outside surface. The metal backup ring 60 may contact the inner surface 50 of the wellbore 6 with a contact stress level sufficient to trap the abrasive grit between the expanded metal backup ring 60 and the inner surface 50 of the wellbore 6 to anchor the wellbore isolation device 400 to the wellbore 6. In an embodiment, the metal backup rings 60A and 60B anchor the wellbore isolation device 16 to the wellbore 6, the sealing elements 38 seal the wellbore isolation device 16 to the wellbore 6, and the metal backup rings 60A and 60B supports the sealing element 38 to prevent sealing element material from moving past the metal backup rings 60A and 60B. The wellbore isolation device 16 isolates the wellbore environment from both directions; that is, the uphole side to the downhole side and the downhole side to the uphole side.

In another embodiment shown with wellbore isolation device 700, the compressive axial force F moves the sealing element 38, a metal backup ring 144, and metal backup ring 146 between the end ring 62 and the mandrel shoulder 52 to radially expand the sealing element 38, metal backup ring 144, and metal backup ring 146 to contact the inner surface 50 of the wellbore 6. The metal backup ring 144 and 146 deforms axially with the downhole leg inner surface moving proximate to the uphole leg inner surface as the top radius expands radially from the initial height H to the expanded height H'. The expanded metal backup ring 144' supports the expanded sealing element 38' to prevent sealing element material from moving past the expanded metal backup ring 144'. In an alternate embodiment, one or both the metal backup rings 144 and 146 may have a coating with abrasive girt applied to all or part of the outside surface. The metal backup ring 144' and 146' may contact the inner surface 50 of the wellbore 6 with no contact stress or with a stress level sufficient to provide a sealing engagement against the wellbore 6 or with a stress level sufficient to trap the abrasive grit between the expanded metal backup ring 144, 146 and the inner surface 50 of the wellbore 6 to anchor the wellbore isolation device 700 to the wellbore 6. The wellbore isolation device 700 isolates the wellbore environment from one direction; that is, the uphole side to the downhole side, but not the downhole side to the uphole side.

In another embodiment, the compressive axial force F moves the sealing element 38 and metal backup ring 118 between the end ring 62 and the mandrel shoulder 52 to radially expand the sealing element 38 and metal backup ring 118 to contact the inner surface 50 of the wellbore 6. The metal backup ring 118 deforms axially until the uphole inner protrusion 134 contacts the downhole inner protrusion 132. The uphole inner leg surface 128 may approach but not contact downhole inner leg surface 126 as the top radius 130 expands radially from the initial height H to the expanded height H'. The expanded metal backup ring 118' supports the expanded sealing element 38 to prevent sealing element material from moving past the expanded metal backup ring 60'. In an alternate embodiment, the metal backup ring 118 may have a coating with abrasive girt 92 applied to all or part of the outside surface. The metal backup ring 118 may contact the inner surface 50 of the wellbore 6 with no contact stress or with a stress level sufficient to provide a sealing engagement against the wellbore 6 or with a stress level sufficient to trap the abrasive grit between the expanded metal backup ring 118 and the inner surface 50 of the wellbore 6 to anchor the wellbore isolation device 400 to the wellbore 6. The wellbore isolation device 800 isolates the wellbore environment from one direction; that is, the uphole side to the downhole side, but not the downhole side to the uphole side.

In another embodiment, the compressive axial force F moves the sealing element 38 and metal backup ring 140 between the end ring 62 and the mandrel shoulder 52 to radially expand the sealing element 38 and metal backup ring 140 to contact the inner surface 50 of the wellbore 6. The metal backup ring 140 deforms axially with the uphole inner leg surface 158 approaches the downhole inner leg surface 156 until the top radius 160 contacts the inner surface 50 of the wellbore 6 and the downhole outer leg surface 166 wedges between the inner surface 50 and the mandrel outer surface 54. As the downhole outer leg surface 166 approaches the inner surface 50 of the wellbore, the top radius 160 expands radially from the initial height H to the expanded height H'. The expanded metal backup ring 118' supports the expanded sealing element 38 to prevent sealing element material from moving past the expanded metal backup ring 60'. In an alternate embodiment, the metal backup ring 140 may have abrasive grit coating 92 applied to all or part of the outside surface. The metal backup ring 140 may contact the inner surface 50 of the wellbore 6 with no contact stress or with a stress level sufficient to provide a sealing engagement against the wellbore 6 or with a stress level sufficient to trap the abrasive grit between the expanded metal backup ring 140 and the inner surface 50 of the wellbore 6 to anchor the wellbore isolation device 900 to the wellbore 6. The wellbore isolation device 900 isolates the wellbore environment from one direction; that is, the uphole side to the downhole side, but not the downhole side to the uphole side.

Having described various systems and methods herein, certain embodiments can include, but are not limited to:

In a first embodiment, a wellbore isolation device, comprising: a mandrel 24 having a cylindrical body with a mandrel outer surface 54 and a central flow passage 28; a sealing element 38 disposed about the mandrel 24 and radially expandable from a first run-in diameter to sealing engagement with the an inner surface 50 of the wellbore 6; a metal backup ring 60 disposed on the mandrel 24 contacting one side of the sealing elements 38 with an initial height H and radially expandable and axially deformable to abut the inner surface 50 of the wellbore 14; wherein the metal backup ring 60 is a concave cross-section about the mandrel 24 with an uphole leg and a downhole leg; and wherein an applied compressive force expands the sealing elements 38 into sealing engagement with the wellbore 6 and the metal backup ring 60 radially expands while axially deforming to abut the inner surface 50 of the wellbore 6 with no contact pressure.

A second embodiment can include the removable wellbore isolation device of the first embodiment, wherein the removable wellbore isolation device is a device selected from the group comprising of a frac plug, a bridge plug, a wellbore packer, an open-hole packer, a cement plug, and any combination thereof.

A third embodiment can include a removable wellbore isolation device of the first embodiment, wherein the metal backup ring 60 radially expands from an initial height H to an expanded height H' that is 80% of the distance from the initial height H to the inner surface 50 of the wellbore 6.

ADDITIONAL DISCLOSURE

The following are non-limiting, specific aspects in accordance with the present disclosure:

A first embodiment, which is a wellbore isolation device, comprising a mandrel 24 having a cylindrical body with an outer surface 54 and a central flow passage 28, a sealing element system 38 disposed about the mandrel 24 and radially expandable from a first run-in diameter to sealing engagement with the an inner surface 50 of the wellbore 6, a metal backup ring 60 disposed on the mandrel 24 contacting one side of the sealing element system 38 with an initial height H and radially expandable and axially deformable to abut the inner surface 50 of the wellbore 6, wherein the metal backup ring 60 is a concave cross-section about the mandrel 24 with an uphole leg and a downhole leg, wherein the sealing element system 38 is configured to radially expand into sealing engagement from an applied compressive force, and wherein the metal backup ring 60 is configured to radially expand and axially deform to abut the inner surface 50 of the wellbore 6 with no contact pressure from the applied compressive force.

A second embodiment, which is the wellbore isolation device of the first embodiment, wherein the wellbore isolation device is a device selected from the group consisting of a frac plug, a bridge plug, a wellbore packer, an open-hole packer, and a cement plug.

A third embodiment, which is the wellbore isolation device of the first embodiment, wherein the metal backup ring 60 is configured to radially expand from an initial height H to an expanded height H' that is 80% of the distance from the initial height H to the inner surface 50 of the wellbore 6.

A fourth embodiment, which is the wellbore isolation device of the first embodiment, wherein abutting the inner surface 50 of the wellbore 6 expands the expanded height H' of the metal backup ring 60 within 0.090 inches of the inner surface 50 of the wellbore 6.

A fifth embodiment, which is the wellbore isolation device of the first embodiment, wherein the metal backup ring 60 is configured to radially expand and axially deform to contact the inner surface 50 of the wellbore 6, and wherein the metal backup ring 60 is configured to abut the inner surface 50 of the wellbore 6 with contact stress ranging from no contact pressure to sealing contact pressure.

A sixth embodiment, which is the wellbore isolation device of the first embodiment, wherein the metal backup ring 60 is configured to radially expand and axially deform to contact the inner surface 50 of the wellbore 6, and wherein the metal backup ring 60 is configured to abut with contact stress ranging from sealing contact pressure to contact pressure exceeding the yield strength of the wellbore 6.

A seventh embodiment, which is the wellbore isolation device of the first embodiment, wherein a cross-section of the metal backup ring 60 has a bellow shape, inverted arc shape, bell shape, or inverted-U shape, and wherein the uphole leg and downhole leg are curved.

An eighth embodiment, which is the wellbore isolation device of the first embodiment, wherein a cross-section of the metal backup ring 60 has an inverted-V shape, and wherein the uphole leg and downhole leg are frustoconical in shape.

A ninth embodiment, which is the wellbore isolation device of the first embodiment, wherein one or more of the metal backup rings 60 has an axial deflection limiting feature on the inside surface of one or more uphole leg or downhole leg.

A tenth embodiment, which is the wellbore isolation device of the first embodiment, wherein the uphole leg and the downhole leg of one or more of the metal backup rings 60 are unequal in length.

An eleventh embodiment, which is the wellbore isolation device of any of the first, the seventh, the eighth, the ninth, or the tenth embodiment, wherein one or more of the metal backup rings 60 has an abrasive coating of sand, grit, or carbide on a portion or all of the outer surface.

A twelfth embodiment, which is the wellbore isolation device of the first embodiment, comprising a second metal backup ring 60 disposed on the mandrel 24 on the opposite side of the sealing element system 38.

A thirteenth embodiment, which is the wellbore isolation device of any of the first or the twelflh embodiment, comprising two or more metal backup rings 60 disposed on the mandrel 24 on one side of the sealing element system 38.

A fourteenth embodiment, which is the wellbore isolation device of any of the first, the twelfh, or the thirteenth embodiment, comprising two or more metal backup rings 60 disposed on the mandrel 24 on the opposite side of the sealing element system 38.

A fifteenth embodiment, which is the wellbore isolation device of any of the first, the eighth, the ninth, or the tenth embodiment, comprising one or more anchoring devices disposed on the mandrel 24 configured to expand to grippingly engage the inner surface of the casing or wellbore in response to a compressive force applied to the removable wellbore isolation device.

A sixteenth embodiment, which is the wellbore isolation device of the fifteenth embodiment, wherein the anchoring device is comprised of one or more metal backup rings 60.

A seventeenth embodiment, which is the wellbore isolation device of the fifteenth embodiment, wherein the anchoring device is a slip on a wedge.

An eighteenth embodiment, which is the wellbore isolation device of any of the sixth, the tenth, the eleventh, or the twelfth embodiment, wherein the metal backup ring 60 is configured to expand into engagement with the casing with limited axial deflection from the applied compressive force.

A nineteenth embodiment, which is the wellbore isolation device of the first embodiment, wherein the metal backup ring 60, mandrel 24, and sealing element system 38 are made from dissolving materials.

A twentieth embodiment, which is the wellbore isolation device of the first embodiment, wherein the wellbore isolation device is configured to be removed by drilling, milling, applied chemicals, corrosion, or dissolving.

A twenty-first embodiment, which is a method, comprising introducing a wellbore isolation device into a wellbore, the wellbore isolation device including a mandrel 24, a sealing element system 38 disposed about the mandrel 24, one or more metal backup ring 60 disposed on the mandrel 24 on one or more sides of the sealing element system 38 and radially expandable and axially deformable into sealing engagement with the wellbore; providing an axial compressive force to the metal backup ring 60, radially deforming the sealing element system 38 into sealing engagement with the wellbore, and radially and axially deforming the metal backup ring 60 into sealing engagement with the wellbore.

A twenty-second embodiment, which is the method of the twenty-first embodiment, wherein providing the axial compressive force expands a slip onto a wedge to grippingly engage the inner wall of the wellbore.

A twenty-third embodiment, which is the method of the twenty-first embodiment, wherein one or more metal backup rings 60 grippingly engage the inner wall of the wellbore.

A twenty-fourth embodiment, which is the method of the twenty-first embodiment, wherein an expandable backup ring 60 is supporting the sealing element 38 in sealing engagement with the wellbore on one side.

A twenty-fifth embodiment, which is the method of the twenty-first embodiment, wherein an expandable backup ring 60 is supporting the sealing element 38 in sealing engagement with the wellbore on both sides.

A twenty-sixth embodiment, which is a method, comprising introducing a wellbore isolation device into a wellbore, expanding a sealing element system 38 into sealing engagement with the inner surface 50 of the wellbore 6, isolating the wellbore environment downhole of the expanded sealing element system 38 from the wellbore environment uphole of the sealing element system 38, axially supporting one side of the sealing element system 38 with an expandable ring 60 that extends from the outer surface 54 of the mandrel 24 to abut the inner surface 50 of the wellbore 6, and containing the axially supported sealing element system 38 from the uphole annular wellbore environment or downhole annular wellbore environment.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A wellbore isolation device, comprising:

a mandrel having a cylindrical body with an outer surface and a central flow passage;

a sealing element system disposed about the mandrel and radially expandable from a first run-in diameter to sealing engagement with an inner surface of the wellbore;

a metal backup ring disposed on the mandrel contacting one side of the sealing element system with an initial height H and radially expandable and axially deformable to abut the inner surface of the wellbore;

wherein the metal backup ring is a concave cross-section about the mandrel with an uphole leg and a downhole leg;

wherein the sealing element system is configured to radially expand into sealing engagement from an applied compressive force; and wherein the metal backup ring is configured to radially expand and axially deform to abut contact the inner surface of the wellbore with radial contact stress establishing sealing contact pressure.

2. The wellbore isolation device of claim 1, wherein the wellbore isolation device is a device selected from the group consisting of a frac plug, a bridge plug, a wellbore packer, an open-hole packer, and a cement plug.

3. The wellbore isolation device of claim 1, wherein the metal backup ring is configured to radially expand and axially deform to contact the inner surface of the wellbore with radial contact stress exceeding the yield strength of the wellbore.

4. The wellbore isolation device of claim 1, wherein a cross-section of the metal backup ring has a bellow shape, inverted arc shape, bell shape, or inverted-U shape; and wherein the uphole leg and downhole leg are curved.

5. The wellbore isolation device of claim 1, wherein a cross-section of the metal backup ring has an inverted-V shape; and wherein the uphole leg and downhole leg are frustoconical in shape and a consistent material thickness.

6. The wellbore isolation device of claim 1, wherein one or more of the metal backup rings has an axial deflection limiting feature on the inside surface of one or more uphole leg or downhole leg.

7. The wellbore isolation device of claim 1, wherein the uphole leg and the downhole leg of one or more of the metal backup rings are unequal in length.

8. The wellbore isolation device of claim 1, wherein one or more of the metal backup rings has an abrasive coating of sand, grit, or carbide on a portion or all of the outer surface.

9. The wellbore isolation device of claim 1, comprising a second metal backup ring disposed on the mandrel on the opposite side of the sealing element system.

10. The wellbore isolation device of claim 1, comprising two or more metal backup rings disposed on the mandrel on one side of the sealing element system.

11. The wellbore isolation device of claim 1, comprising two or more metal backup rings disposed on the mandrel on the opposite side of the sealing element system.

12. The wellbore isolation device of claim 1, comprising one or more anchoring devices disposed on the mandrel configured to expand to grippingly engage the inner surface of the wellbore in response to a compressive force applied to the removable wellbore isolation device.

13. The wellbore isolation device of claim 1, wherein the metal backup ring is configured to expand into engagement with the wellbore: wherein a downhole inner protrusion contacts an uphole inner protrusion of the metal backup ring; and thereby limits the axial deflection from the applied compressive force.

14. The wellbore isolation device of claim 1, wherein the metal backup ring, mandrel, and sealing element system are made from dissolving materials.

15. The wellbore isolation device of claim 1, wherein the wellbore isolation device is configured to be removed by drilling, milling, applied chemicals, corrosion, or dissolving.

16. A method, comprising:

introducing a wellbore isolation device into a wellbore, the wellbore isolation device including a mandrel, a sealing element system disposed about the mandrel, one or more metal backup ring disposed on the mandrel on one or more sides of the sealing element system and radially expandable and axially deformable into sealing engagement with the wellbore;

providing an axial compressive force to the metal backup ring;

radially deforming the sealing element system into sealing engagement with the wellbore; and radially and axially deforming the metal backup ring into sealing engagement with the wellbore.

17. The method of claim 16, wherein an expandable backup ring is supporting the sealing element in sealing engagement with the wellbore on one side.

18. The method of claim 16, wherein an expandable backup ring is supporting the sealing element in sealing engagement with the wellbore on both sides.

19. A method, comprising:

introducing a wellbore isolation device into a wellbore, expanding a sealing element system into sealing engagement with the inner surface of the wellbore;

isolating the wellbore environment downhole of the expanded sealing element system from the wellbore environment uphole of the sealing element system;

axially supporting one side of the sealing element system with an expandable ring that extends from the outer surface of the mandrel to contact the inner surface of the wellbore with sealing contact pressure; and containing the axially supported sealing element system from the uphole annular wellbore environment or downhole annular wellbore environment.

20. The apparatus of claim 1, wherein the wellbore is a casing, a liner, a tubing, or an open-hole wellbore.

* * * * *